US007613414B2

(12) United States Patent
Kamimura

(10) Patent No.: US 7,613,414 B2
(45) Date of Patent: Nov. 3, 2009

(54) DEVELOPING CARTRIDGE, PROCESS CARRIAGE, AND IMAGE FORMING APPARATUS

(75) Inventor: Naoya Kamimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 417 days.

(21) Appl. No.: 11/526,601

(22) Filed: Sep. 26, 2006

(65) Prior Publication Data

US 2007/0140725 A1 Jun. 21, 2007

(30) Foreign Application Priority Data

Sep. 27, 2005 (JP) ..... 2005-280229

(51) Int. Cl.

| | |
|---|---|
| ***G03G 15/00*** | (2006.01) |
| ***G03G 21/16*** | (2006.01) |
| ***G03G 15/04*** | (2006.01) |
| ***G03G 15/08*** | (2006.01) |

(52) U.S. Cl. ..... 399/90; 399/111; 399/119; 399/285

(58) Field of Classification Search ..... 399/90, 399/111, 119, 279, 285

See application file for complete search history.

(56) References Cited

U.S. PATENT DOCUMENTS

| | | | | |
|---|---|---|---|---|
| 6,272,299 | B1 | 8/2001 | Numagami et al. | |
| 6,389,250 | B1 * | 5/2002 | Numagami et al. | 399/111 |
| 6,823,160 | B2 | 11/2004 | Okabe | |
| 2004/0028424 | A1 * | 2/2004 | Yokoi | 399/90 |
| 2005/0063735 | A1 | 3/2005 | Okabe | |
| 2006/0029418 | A1 * | 2/2006 | Ishii et al. | 399/111 |

FOREIGN PATENT DOCUMENTS

| | | |
|---|---|---|
| JP | 10020743 | 1/1998 |
| JP | 2003-295614 | 10/2003 |

* cited by examiner

*Primary Examiner*—Sandra L Brase
(74) *Attorney, Agent, or Firm*—Banner & Witcoff, Ltd

(57) ABSTRACT

A developing cartridge that includes: a developing roller having a developing roller gear and a driving force transmitting unit; and an electrode member for applying a bias to a developing roller shaft. A direction of a driving force applied to the developing roller gear at an engagement portion between the developing roller gear and a transmission gear when the developing roller gear and the transmission gear rotate, and a direction of a force applied to the electrode member at a contact portion between a power supply member and the electrode member when the power supply member presses on the electrode member are substantially equal to a direction orthogonal to the axial direction of the developing roller shaft.

11 Claims, 14 Drawing Sheets

DEVELOPING CARTRIDGE, PROCESS CARRIAGE, AND IMAGE FORMING APPARATUS

CROSS REFERENCE TO RELATED APPLICATION

This application claims priority from Japanese Patent Application No. 2005-280229, filed Sep. 27, 2005, the contents of which are hereby incorporated by reference into the present application.

TECHNICAL FIELD

Aspects of the present invention relate to an image forming apparatus, such as a laser printer and the like, and a developing cartridge and a process cartridge that are mounted on the image forming apparatus.

BACKGROUND

Generally, in an image forming apparatus, such as a laser printer and the like, a developing cartridge, on which a developing roller is rotatably supported, is detachably mounted (for example, see JP-A-2003-295614).

In such a developing cartridge, an input gear for transmitting a driving force to the developing roller is provided on one side wall of a casing for containing the developing roller. The input gear engages with a developing roller driving gear of the developing roller. When the developing cartridge is mounted on a main body of the image forming apparatus, the input gear is coupled with a coupling member that is provided on the main body of the image forming apparatus, so that it transmits a driving force from the coupling member to the developing roller driving gear.

Further, in the developing cartridge, on the other side wall of the casing, an electrode member for applying a developing bias to the developing roller is provided. The electrode member is integrally formed with a bearing member that supports a developing roller shaft of the developing roller. When the developing cartridge is mounted on the main body of the image forming apparatus, the electrode member comes into contact with an electrode plate that is provided on the main body of the image forming apparatus, such that it applies a developing bias supplied from the electrode plate to the developing roller shaft.

SUMMARY

In the above-described developing cartridge, when images are formed, the input gear applies the driving force transmitted from the coupling member to the developing roller driving gear. However, a direction of a power (direction of a pressure angle) applied to the developing roller driving gear at an engagement portion between the developing roller driving gear and the input gear when the developing roller gear and the input gear rotate, and a direction of a power (pressing direction) applied to the electrode member at a contact portion between the electrode plate and the electrode member when an electrode plate presses on the electrode member are different from each other.

For this reason, in an axial direction of the developing roller shaft, torsion occurs in the developing cartridge. As a result, defects might occur when images are formed.

Aspects of the invention provide a developing cartridge, a process cartridge on which the developing cartridge is mounted, and an image forming apparatus on which the developing cartridge and the process cartridge is mounted, in which when images are formed, a balance between a power applied to a developing roller gear and a power applied to an electrode member can be taken, torsion of the developing cartridge can be suppressed, and image forming defects can be prevented.

DETAILED DESCRIPTION

General Overview

Figure 1:
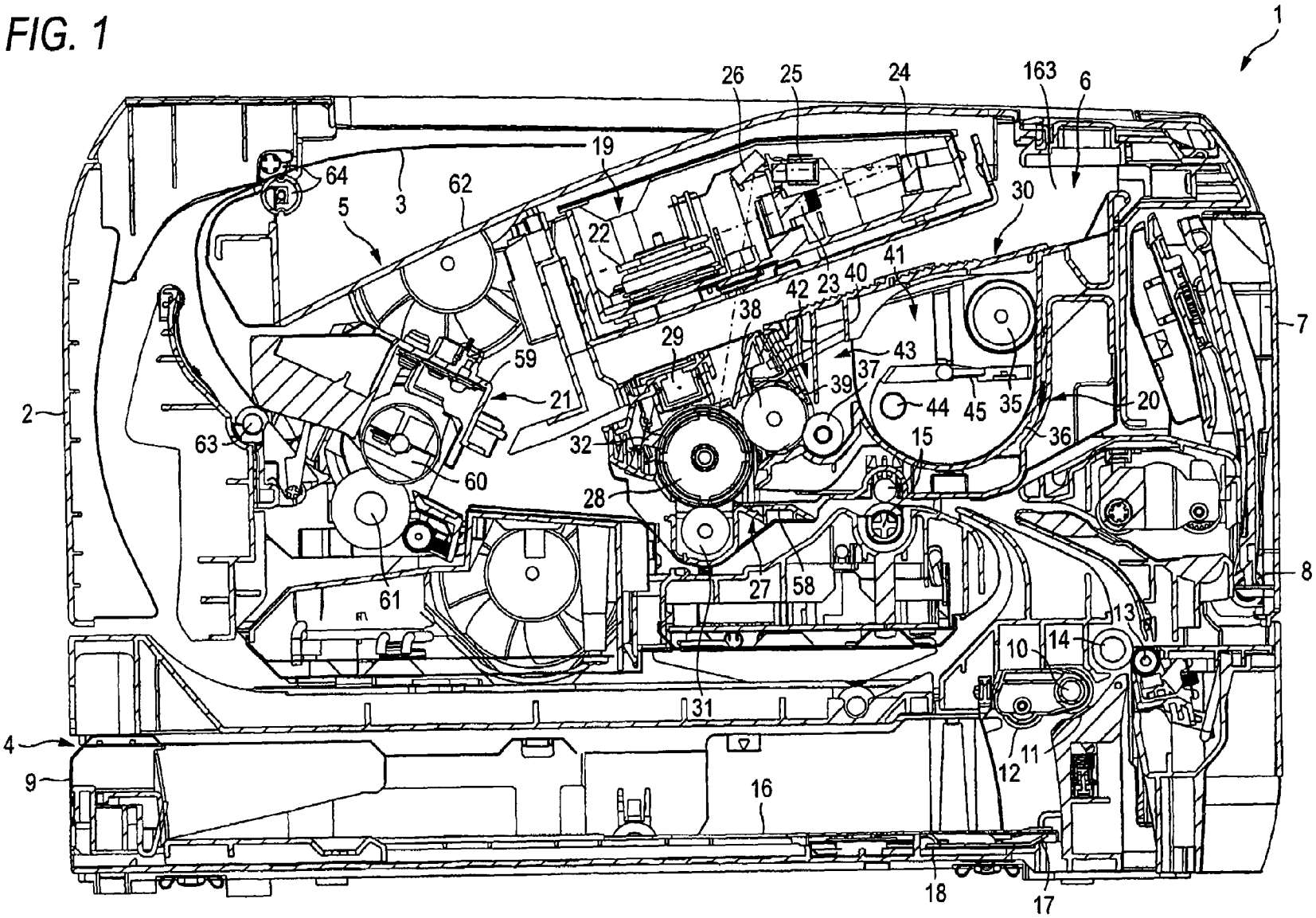
FIG. 1 is a side cross-sectional view illustrating a laser printer serving as an image forming apparatus according to an aspect of the invention.

According to a first aspect of the invention, there is provided a developing cartridge that is attachable to and detachable from an image forming device. The developing cartridge includes a developing roller that includes a developing roller shaft, which rotates at a time of development, a developing roller member provided at a circumference of the developing roller shaft to carry a developer, and a developing roller gear provided to rotate integrally with the developing roller shaft at one side of the developing roller shaft in an axial direction; a driving force transmitting unit that is disposed on the one side of the developing roller shaft in the axial direction and transmits a driving force from a driving rotator provided in the image forming apparatus to the developing roller gear, the driving force transmitting unit including a driven rotator connectable to the driving rotator and a transmission gear that engages with the developing roller gear; and an electrode member that is disposed on an other side of the developing roller shaft in the axial direction and comes into contact with a power supply member to apply a bias supplied by the power supply member to the developing roller shaft, wherein a direction of the driving force applied to the developing roller gear at an engagement portion between the developing roller gear and the transmission gear when the developing roller gear and the transmission gear rotate, and a direction of a force applied to the electrode member at a contact portion between the power supply member and the electrode member when the power supply member presses on the electrode member are substantially equal to a direction orthogonal to the axial direction of the developing roller shaft.

According to this configuration, if the developing cartridge is mounted on the image forming apparatus, at one side of the developing roller shaft in the axial direction, the driven rotator of the driving force transmitting unit is connected to the driving rotator that is provided in the image forming apparatus, and at the other side of the developing roller shaft in the axial direction, the electrode member comes into contact with the power supply member.

In addition, when images are formed, in the driving force transmitting unit, the driving force from the driving rotator is transmitted to the driven rotator, and the driving force is transmitted from the transmitting gear to the developing roller gear, which results in rotating the developing roller. Further, the bias from the power supply member is applied to the electrode member, the bias is applied from the electrode member to the developing roller shaft, and the bias is applied to the developing roller.

In addition, at the time of forming the images, in the developing cartridge, a direction of a power applied to the developing roller gear at the engagement portion between the developing roller gear and the transmission gear when the developing roller gear and the transmission gear rotate, and a direction of a power applied to the electrode member at the contact portion between the power supply member and the electrode member when the power supply member presses on the electrode member are substantially equal to a direction orthogonal to the axial direction of the developing roller shaft.

Accordingly, at the time of forming the images, since the developing cartridge is pressed in substantially the same direction with an excellent balance from both sides of the axial direction in the axial direction of the developing roller shaft, it is possible to suppress torsion from occurring in the developing cartridge in the axial direction of the developing roller shaft. As a result, defects occurring when the images are formed can be prevented.

Further, according to a second aspect of the invention, in the developing cartridge according to the first aspect of the invention, the engagement portion between the developing roller gear and the transmission gear, and the contact portion between the power supply member and the electrode member are disposed on a straight line that is parallel to the developing roller shaft.

According to this configuration, the engagement portion between the developing roller gear and the transmission gear, and the contact portion between the power supply member and the electrode member are disposed on a straight line that is parallel to the developing roller shaft. Therefore, an action point of a power applied to the developing roller gear and an action point of a power applied to the electrode member are on the same straight line. As a result, it is possible to more effectively suppress the torsion occurring in the developing cartridge.

Further, according to a third aspect of the invention, in the developing roller cartridge according to the first aspect or the second aspect, the electrode member includes a developing roller supporting portion that supports the developing roller shaft and a contact portion that comes into contact with the power supply member, which are integrally provided.

According to this configuration, the electrode member can make the contact portion come into contact with the power supply member while supporting the developing roller shaft by the developing roller supporting portion. Therefore, the number of components can be reduced, the developing roller can be easily and surely supported, and the bias can be easily and surely applied to the developing roller.

According to a fourth aspect of the invention, in the developing cartridge according to any one of the first to third aspects, the developing cartridge further includes a casing that contains the developing roller and has an opening through which the developing roller member is partially exposed. Further, a direction of the driving force applied to the developing roller gear and a direction of the force applied to the electrode member extend toward the opening from the engagement portion between the developing roller gear and the transmission gear and the contact portion between the power supply member and the electrode member, respectively, in the direction orthogonal to the axial direction of the developing roller shaft.

According to this configuration, a direction of a power applied to the developing roller gear from the engagement portion between the developing roller gear and the transmission gear, and a direction of a power applied to the electrode member from the contact portion between the power supply member and the electrode member are toward the opening of the casing through which the developing roller member is partially exposed. For this reason, at the time of forming the images, the developing roller can press on the photosensitive member on which the electrostatic latent image developed by the developing roller is formed. As a result, when the images are formed, the contact area between the developing roller and the photosensitive member can be increased, and thus the development can be more surely performed.

According to a fifth aspect of the invention, in the developing cartridge according to any one of the first to fourth aspects, the driving force transmitting unit includes the driven rotator and the transmission gear, which are integrally provided on the same axial line.

According to this configuration, the driving force transmitting unit includes the driven rotator and the transmission gear, which are integrally provided on the same axial line. Therefore, the number of components can be reduced, and the driving force from the driving rotator can be effectively transmitted to the developing roller gear.

Further, according to a sixth aspect of the invention, there is provided a process cartridge that is attachable to and detachable from an image forming device. The process cartridge includes the developing cartridge according to any one of the first to fifth aspects, a photosensitive member on which an electrostatic latent image is formed, and a developing cartridge containing portion that contains the developing cartridge.

According to this configuration, since the process cartridge includes the developing cartridge in which the torsion is suppressed from occurring, when the images are formed, it is possible to achieve stable development of the photosensitive member.

Further, according to a seventh aspect of the invention, in the process cartridge according to the sixth aspect of the invention, the developing roller member is disposed to come into contact with the photosensitive member, and a direction of a power applied to the developing roller gear, and a direction of a power applied to the electrode member are substantially equal to a direction where the developing roller member presses on the photosensitive member, in order to increase a contact area between the developing roller member and the photosensitive member.

According to this configuration, a direction of a power applied to the developing roller gear, and a direction of a power applied to the electrode member is substantially equal to a direction where the developing roller member presses on the photosensitive member, in order to increase a contact area between the developing roller member and the photosensitive member. Therefore, when the images are formed, the contact area between the developing roller and the photosensitive member can be increased, which results in achieving sure development.

Further, according to an eighth aspect of the invention, there is provided an image forming apparatus. The image forming apparatus includes the process cartridge according to the sixth aspect or the seventh aspect, a process cartridge containing portion that contains the process cartridge, the driving rotator, and the power supply member.

According to this configuration, the image forming apparatus includes the developing cartridge in which the torsion is suppressed from occurring. Therefore, when the images are formed, it is possible to prevent image forming defects due to the torsion of the developing cartridge.

Further, according to a ninth aspect of the invention, in the image forming apparatus according to the eighth aspect of the invention, the power supply member is made of a conductive wire rod, and includes a winding portion which the conductive wire rod is wound around, and two arms that extend respectively in different directions spaced apart from the winding portion which the conductive wire rod is wound around, and supporting portions for supporting the two arms are provided in the process cartridge containing portion such that the electrode member of the developing cartridge comes into contact with the winding portion.

According to this configuration, in the power supply member, in a state in which the two arms are supported by the supporting portion, the winding portion comes into contact with the electrode member between the arms. That is, in a state in which both ends of the winding portion are supported, the winding portion comes into contact with the electrode member. For this reason, as compared with a case in which the winding portion is pivoted in a state in which only one end of the winding portion is supported, a pivot range can be reduced, and an arrangement space required when the winding portion is disposed can be reduced. Therefore, it is possible to achieve a small-sized image forming apparatus.

Further, according to a tenth aspect of the invention, there is provided an image forming apparatus. The image forming apparatus includes the developing roller cartridge according to any one of the first to fifth aspects, a developing cartridge containing portion that contains the developing cartridge, the driving rotator, and the power supply member.

According to this configuration, since the image forming apparatus includes the developing cartridge in which the torsion is prevented from occurring, when the images are formed, it is possible to prevent image forming defects due to the torsion of the development cartridge.

Further, according to an eleventh aspect of the invention, in the image forming apparatus according to the tenth aspect of the invention, the power supply member is made of a conductive wire rod, and includes a winding portion which the conductive wire rod is wound around, and two arms that extend respectively in different directions spaced apart from the winding portion which the conductive wire rod is wound around, and supporting portions for supporting the two arms are provided in the developing cartridge containing portion such that the electrode member of the developing cartridge comes into contact with the winding portion.

According to this configuration, in the power supply member, in a state in which the two arms are supported by the supporting portion, the winding portion comes into contact with the electrode member between the arms. That is, in a state in which both ends of the winding portion are supported, the winding portion comes into contact with the electrode member. For this reason, as compared with a case in which the winding portion is pivoted in a state in which only one end of the winding portion is supported, a pivot range can be reduced, and an arrangement space required when the winding portion is disposed can be reduced. Therefore, it is possible to achieve a small-sized image forming apparatus.

Advantage of the Invention

According to the first aspect of the invention, it is possible to prevent the torsion from occurring in the image forming apparatus. Therefore, image forming defects can be prevented.

According to the second aspect of the invention, the torsion of the developing cartridge can be more effectively suppressed.

According to the third aspect of the invention, the supporting of the developing roller and the applying of the bias to the developing roller can be easily and surely achieved.

According to the fourth aspect of the invention, when the images are formed, the contact area between the developing roller and the photosensitive member can be increased. Therefore, it is possible to more surely perform development.

According to the fifth aspect of the invention, the number of components can be reduced, and the driving force from the driving rotator can be effectively transmitted to the developing roller gear.

According to a sixth aspect of the invention, when the images are formed, it is possible to achieve stable development of the photosensitive member.

According to the seventh aspect of the invention, when the images are formed, the contact area between the developing roller and the photosensitive member can be increased. Therefore, it is possible to surely achieve the development.

According to an eighth aspect of the invention, when the images are formed, it is possible to prevent image forming defects due to the torsion in the developing cartridge.

According to a ninth aspect of the invention, it is possible to achieve a small-sized image forming apparatus.

According to a tenth aspect of the invention, when the images are formed, it is possible to prevent image forming defects due to the torsion in the developing cartridge.

According to an eleventh aspect of the invention, it is possible to achieve a small-sized image forming apparatus.

1. Overall Structure of Laser Printer

Figure 2:
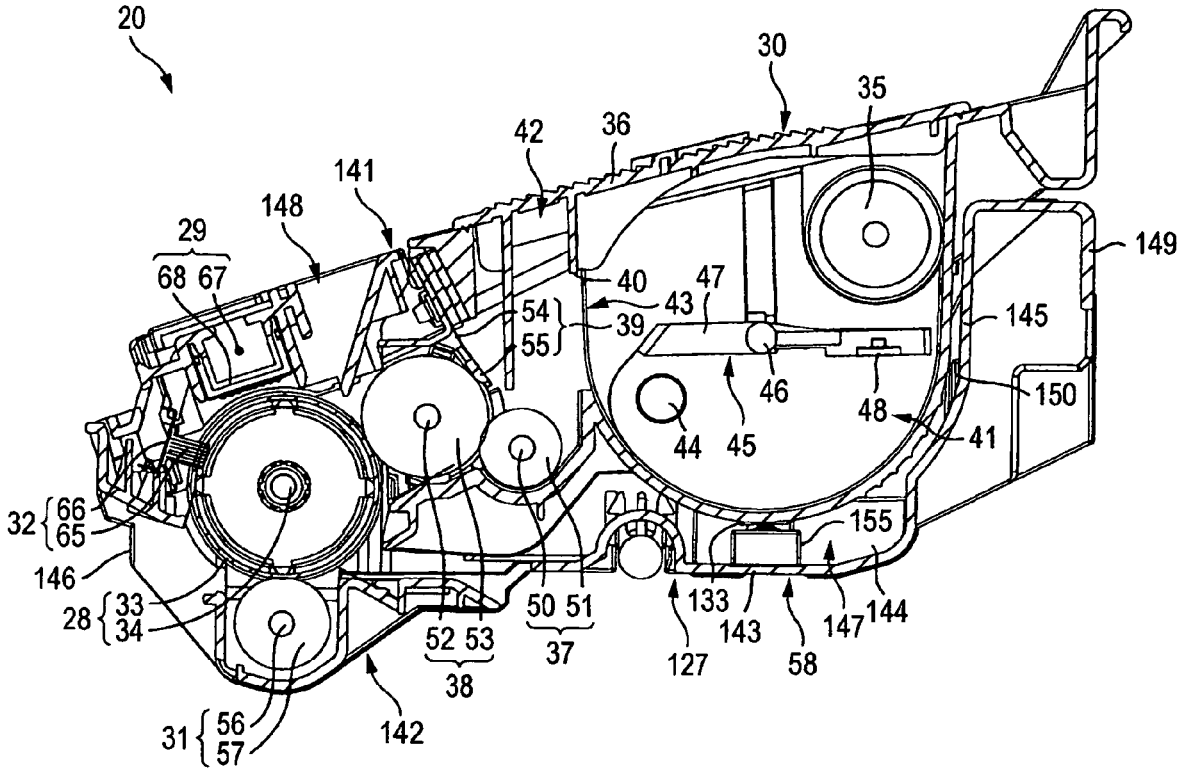
FIG. 2 is a side cross-sectional view illustrating a process cartridge of the laser printer shown in FIG. 1.
Figure 3:
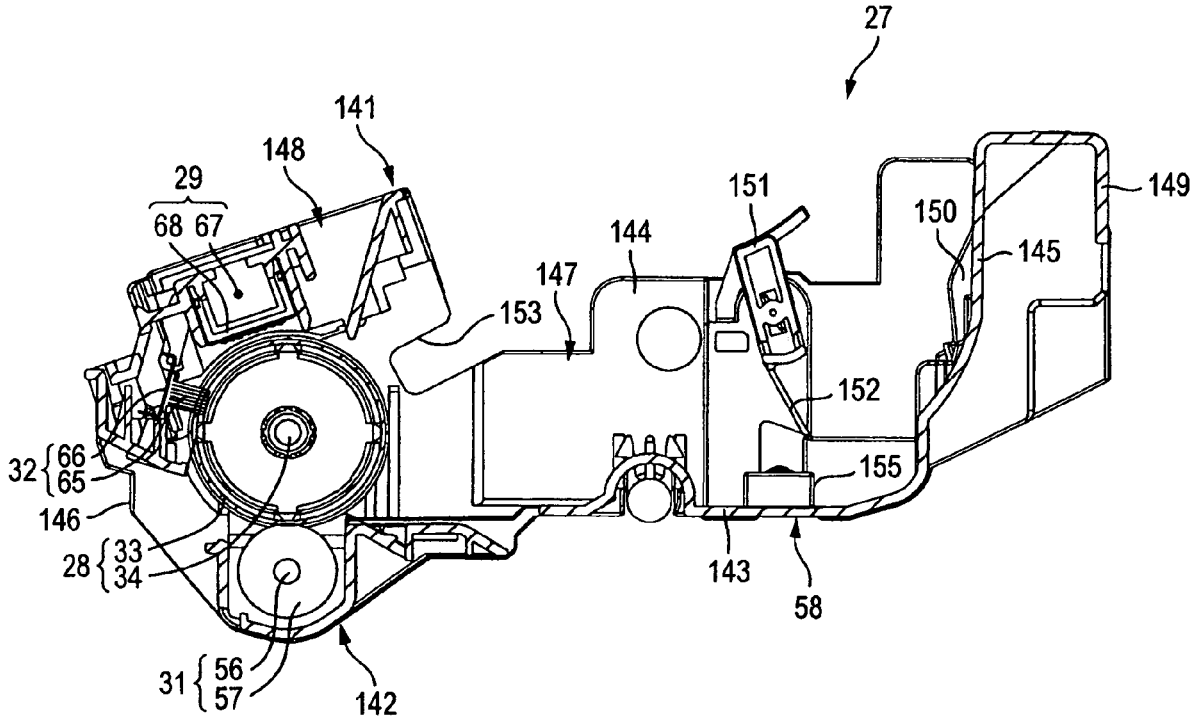
FIG. 3 is a side cross-sectional view illustrating a drum cartridge of the laser printer shown in FIG. 1.
Figure 4:
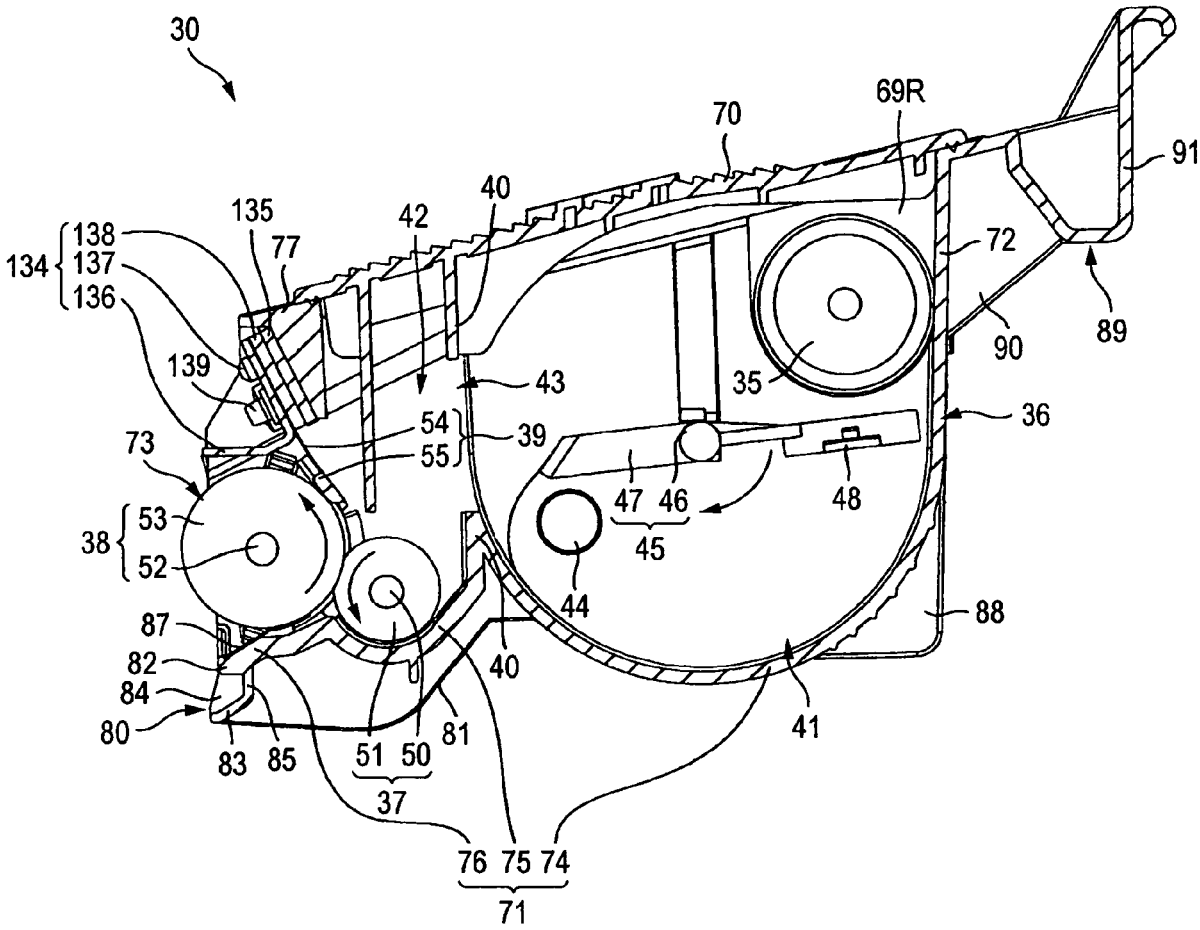
FIG. 4 is a side cross-sectional view illustrating a developing cartridge of the laser printer shown in FIG. 1.

FIG. 1 is a side cross-sectional view illustrating a laser printer serving as an image forming apparatus according to an aspect of the invention. FIG. 2 is a side cross-sectional view illustrating a process cartridge of the laser printer shown in FIG. 1. FIG. 3 is a side cross-sectional view illustrating a drum cartridge of the laser printer shown in FIG. 1. FIG. 4 is a side cross-sectional view illustrating a developing cartridge of the laser printer shown in FIG. 1.

As shown in FIG. 1, a laser printer 1 includes a main body casing 2, and a feeder portion 4 that feeds a sheet 3 and an image forming unit 5 that forms an image on the fed sheet 3, which are contained in the main body casing 2.

(1) Main Body Casing

In the main body casing 2, a process cartridge containing portion 6 is formed to contain a process cartridge 20, which will be described in detail below. Further, in the main body casing 2, a front cover 7 is provided to open and close the process cartridge containing portion 6. The front cover 7 is rotatably supported by a cover shaft 8 that is inserted through a lower end of the front cover 7. Accordingly, if the front cover 7 is closed with the cover shaft 8 as a fulcrum, the front cover 7 covers the process cartridge containing portion 6. In contrast, if the front cover 7 is opened with the cover shaft 8 as a fulcrum, the process cartridge containing portion 6 is opened. As a result, the process cartridge 20 can be attached to or detached from the process cartridge containing portion 6.

In the description below, in a state in which the process cartridge 20 is mounted on the process cartridge containing portion 6 of the main body casing 2, a side where the front cover 7 is provided is referred to as a 'front side', and a side opposite to the front side is referred to as a 'rear side'.

(2) Feeder Portion

As shown in FIG. 1, the feeder portion 4 includes a sheet feed tray 9 that is mounted so as to be attached to or detached from the main body casing 2 along a forward-to-backward direction, a separation roller 10 and a separation pad 11 that are provided on a front end of the sheet feed tray 9, and a sheet feed roller 12 that is provided on a rear side of the separation roller 10 (upstream side of a conveyance direction of the sheet 3 with respect to the separation pad 11), all of them are formed on a bottom portion of the main body casing 2. Further, the feeder portion 4 includes a paper dust removing roller 13 that is provided on an upper side in front of the separation roller 10 (downstream side of the conveyance direction of the sheet 3 with respect to the separation roller 10), and a pinch roller 14 that is disposed to be opposite to the paper dust removing roller 13.

Further, a conveyance path of the sheet 3 at the sheet feed side extends toward a downstream side of a conveyance direction after being bent toward a rear side in a substantially U shape from a neighboring portion of the paper dust removing roller 13. Under the process cartridge 20, a register roller 15 that is composed of a pair of rollers is provided in the feeder portion 4.

A sheet pressing plate 16, on which the sheets 3 are placed in a stacked manner, is provided in the sheet feed tray 9. A rear end of the sheet pressing plate 16 is pivotally supported. As a result, the sheet pressing plate 16 can be pivoted between a sheet staking location along a bottom plate of the sheet feed tray 9 at which the front end of the sheet pressing plate 16 is disposed downward and an inclined sheet supply location at which the front end of the sheet pressing plate 16 is disposed upward.

Further, at the front end of the supply tray 9, a lever 17 for lifting the front end of the sheet pressing plate 16 upward is provided. At a location under the front end of the sheet pressing plate 16, the lever 17 can be pivoted between a lying posture at which the tip end of the lever 17 lies on the bottom plate of the sheet feed tray 9 and a base end thereof is supported by a lever shaft 18 to be pivoted, and an inclined posture at which the tip end lifts the sheet pressing plate 16. In addition, if the driving force is applied to the lever shaft 18, the lever 17 rotates with the lever shaft 18 as a fulcrum, and the tip end of the lever 17 lifts the front end of the sheet pressing plate 16 so as to move the sheet pressing plate 16 to the supply location.

If the sheet pressing plate 16 moves to the supply location, the uppermost sheet 3 that is disposed on the sheet pressing plate 6 is pressurized by the sheet feed roller 12. As the sheet feed roller 12 rotates, the sheet starts to be fed toward a separation location between the separation roller 10 and the separation pad 11.

Further, if the sheet feed tray 9 is detached from the main body casing 2, the sheet pressing plate 16 is disposed at the sheet staking location. If the sheet pressing plate 16 is disposed at the sheet staking location, the sheet 3 can be placed in a stacked manner on the sheet pressing plate 16.

As the separation roller 10 rotates, when the sheet 3 fed to the separation location by the sheet feed roller 12 is interposed between the separation roller 10 and the separation pad 11, the sheet is separated one by one and then fed. The fed sheet 3 passes between the paper dust removing roller 13 and the pinch roller 14 such that paper dusts are removed. Then, the sheet 3 is bent along the conveyance path of a U shape at the sheet feed side and then conveyed toward the register roller 15.

After registration, the register roller 15 conveys the sheet 3 to a transfer location between a photosensitive drum 28 serving as a photosensitive member and a transfer roller 31 where a toner image on the photosensitive drum 28 is transferred to the sheet 3.

(3) Image Forming Unit

The image forming unit 5 includes a scanner unit 19, a process cartridge 20, and a fixing unit 21.

(a) Scanner Unit

The scanner unit 19 is provided in a top portion of the main body casing 2, and includes a laser light source (not shown), a polygon mirror 22 that is driven to rotate, an fθ lens 23, a reflecting mirror 24, a lens 25, and a reflecting mirror 26. The laser light source emits a laser beam based on image data. Then, as indicated by a broken line, the laser beam is deflected by the polygon mirror 22, passes through the fθ lens 23, and is reflected rearward by the reflecting mirror 24. After passing through the lens 25, the laser beam is further reflected downward by the reflecting mirror 26 and then irradiated on a surface of the photosensitive drum 28 of the process cartridge 20.

(b) Process Cartridge

The process cartridge 20 is provided below the scanner unit 19 in the main body casing 2, and it is mounted in the process cartridge containing portion 6 of the main body casing 2 to be attached to or detached therefrom.

As shown in FIG. 2, the process cartridge 20 includes a drum cartridge 27, and a developing cartridge 30 that is mounted in the drum cartridge 27 to be attached to or detached from the drum cartridge 27.

(b-1) Drum Cartridge

As shown in FIG. 3, the drum cartridge 27 includes a drum frame 58, a photosensitive drum 28, a scorotron charger 29, a transfer roller 31, and a cleaning member 32, which are provided in the drum frame 58.

The drum frame 58 includes an upper casing 141 that supports the scorotron charger 29 and the cleaning member 32, and a lower casing 142 that supports the photosensitive drum 28 and the transfer roller 31.

The lower casing 142 has a bottom wall 143 that has a substantially rectangular flat shape, a pair of side walls 144 that are opposite to each other at both sides of the bottom wall 143 in a widthwise direction (it is set to a direction orthogonal to a forward-to-backward direction in plan view. Further, the 'widthwise direction' is set to a direction parallel to the developing roller shaft 52 to be described below, and the 'forward-to-backward direction' is set to a direction orthogonal to the developing roller shaft 52), a front wall 145 that is disposed on the front end of the bottom wall 143, and a rear wall 146 that is disposed on the rear end of the bottom wall 143, which are integrally formed with each other. The lower casing 142 is formed in a bottomed frame shape in which its upper side is opened.

In the lower casing 142, the front side becomes a developing cartridge mounting portion 147 on which the developing cartridge 30 is mounted, and the rear side becomes a drum supporting portion 148 in which the upper casing 141 is disposed to be opposite in a vertical direction.

The upper casing 141 is assembled from the upper side with respect to the rear side of the lower casing 142 so as to cover the rear side of the lower casing 142.

The photosensitive drum 28 forms a cylindrical shape, and has a drum main body 33 whose uppermost layer is formed by a photosensitive layer made of a positively chargeable material, such as polycarbonate, and a metallic drum shaft 34 that extends along an axial direction of the drum main body 33 at the center of the drum main body 33. The drum shaft 34 is supported on the side wall 144 of the lower casing 142, and the drum main body 33 is supported by the drum shaft 34 rotatably. Further, at the time of forming images, the photosensitive drum 28 is applied with a driving force by a motor (not shown), so that it is driven to rotate about the drum shaft 34.

At an obliquely upward side at the rear of the photosensitive drum 28, the scorotron charger 29 is supported by the upper casing 141, and disposed opposite to the photosensitive drum 28 at a predetermined interval, such that the scorotron charger 29 does not come into contact with the photosensitive drum 28. The scorotron charger 29 includes a discharge wire 67 that is disposed to be opposite to the photosensitive drum 28 at a predetermined interval, and a grid 68 that is provided between the discharge wire 67 and the photosensitive drum 28 and controls an amount of a charge supplied from the discharge wire 67 to the photosensitive drum 28. In the scorotron charger 29, at the time of forming images, a bias voltage is applied to the grid 68 while a high voltage is applied to the discharge wire 67, such that the discharge wire 67 is corona-discharged, which results in charging a surface of the photosensitive drum 28 uniformly with a positive polarity.

In the lower casing 142, the transfer roller 31 is provided below the photosensitive drum 28, and disposed opposite to the photosensitive drum 28 in a vertical direction so as to come into contact with the photosensitive drum 28. Further, the transfer roller 31 is disposed to form a nip between the photosensitive drum 28 and the transfer roller 31. The transfer roller 31 includes a metallic transfer roller shaft 56 and a rubber roller 57 made of a conductive rubber material to cover the transfer roller shaft 56. The transfer roller shaft 56 is supported on the side wall 144 of the lower casing 142 rotatably. At the time of transfer (at the time of forming images), the transfer roller 31 is applied with a driving force from a motor (not shown), and driven to rotate. Further, at the time of transfer, a transfer bias is applied to the transfer roller 31.

The cleaning member 32 is supported by the upper casing 141, and disposed to be opposite to the photosensitive drum 28 at the rear side of the photosensitive drum 28. The cleaning member 32 has a cleaning brush 65 that captures paper dusts attached to the photosensitive drum 28, and a support plate 66 that supports the cleaning brush 65 at the side (rear side) opposite to the photosensitive drum 28 with respect to the cleaning brush 65.

The cleaning brush 65 is made of non-woven fabric in which a plurality of fibrous brush hairs having conductivity are implanted, and bonded to the support plate 66 by means of a both-sided tape. The cleaning brush 65 is disposed opposite to the photosensitive drum 28 so as to come into contact with the photosensitive drum 28.

In a state in which the support plate 66 supports the cleaning brush 65, it is supported by the upper casing 141.

In the developing cartridge mounting portion 147, in the center portion of the front wall 145 in a widthwise direction, a handle 149 for holding is formed to be used when the drum cartridge 27 is attached to or detached from the developing cartridge mounting portion 147.

Further, pressing levers 150 are respectively provided on both ends of the front wall 145 in a widthwise direction, such that they press on the developing cartridge 30 mounted on the developing cartridge mounting portion 147 rearward, and makes the developing roller 38 come into contact with the photosensitive drum 28 in a pressurized state.

Each of the pressing levers 150 is made of a thick plate having a triangular shape in a side view, and a lower end of the pressing lever 150 is pivotably supported by a fixed shaft (not shown) protruding from the side wall 144 toward an inner side of a widthwise direction.

Further, in front of each pressing lever 150, a compression spring (not shown) is interposed between the front wall 145 and the pressing lever 150. Accordingly, each of the pressing levers 150 is supported to be always inclined rearward by a biasing force of the compression spring.

Further, in one of the side walls 144, a locking lever 151 is provided at a predetermined interval from one pressing lever 150 in a forward-to-backward direction. The locking lever 151 forms a substantially rectangular shape in a side view, and has a flexible piece 152 extending downward from the locking lever 151. The locking lever 151 is supported on one side wall 144 rotatably, in a state in which the flexible piece 152 is locked to a rib (not shown) of the bottom wall 143.

Further, in the developing cartridge mounting portion 147, in the rear ends of the respective side walls 144, in order to guide the mounting of the developing cartridge 30, guide grooves 153 into which a collar member 116 to be described below and a developing roller shaft covering portion 118 are fitted are formed.

Further, in the developing cartridge mounting portion 147, on the front side from the center of the bottom wall 143 in a forward-to-backward direction, a mounting stage 155, on which a mounting portion 133 of the developing cartridge 30 to be described below is mounted, is provided.

(b-2) Developing Cartridge

In a state in which the process cartridge 20 is detached from the process cartridge containing portion 6 of the main body casing 2, the developing cartridge 30 is detachably mounted in the cartridge mounting portion 147 of the drum cartridge 27.

As shown in FIG. 4, the developing cartridge 30 includes a developing frame 36 that serves as a casing, a supply roller 37, a developing roller 38, and a layer-thickness regulating plate 39 that are provided in the developing frame 36.

The developing frame 36 is formed in a box shape such that its rear side is opened, which will be described in detail below. In the developing frame 36, a partition wall 40, and a toner containing chamber 41 and a developing chamber 42 partitioned by the partition wall 40 are provided.

The partition wall 40 is disposed in the middle of a forward-to-backward direction of the developing frame 36, and partitions an inner portion of the developing frame 36 in the forward-to-backward direction. In the middle of the forward-to-backward direction of the partition wall 40, a communicating opening 43 is formed.

The toner containing chamber 41 is formed as an inner space of the front side of the developing frame 36 that is partitioned by the partition wall 40. In the toner containing chamber 41, a toner of a non-magnetic mono component that is positively chargeable is contained as a developer. As the toner, a polymerization toner, which is obtained by polymerizing a polymerizable monomer, for example, a styrene based monomer, such as styrene or the like, or an acrylic monomer, such as an acrylic acid, alkyl (C1 to C4) acrylate, alkyl (C1 to C4) methacrylate, or the like by suspension polymerization or the like, is used. The polymerization toner has a substantially spherical shape and very superior fluidity, and a high-resolution image can be formed by using the polymerization toner.

Further, in this toner, a coloring material, such as carbon black or the like, or wax is compounded. In order to improve fluidity, an external additive, such as silica, is added. An average diameter of the toner is within a range of 6 to 10 μm.

Further, in the toner containing chamber 41, a toner supply opening for filling a toner is formed in a right wall 69R (which will be described in detail below) of the developing frame 36 in the toner containing chamber 41, and the toner supply opening is covered by a toner cap 35 (see FIG. 6).

Further, in the toner containing chamber 41, toner detecting windows 44 for detecting a remaining toner amount are respectively formed at both side walls 69L and 69R (which will be described in detail below) of the developing frame 36. In the vicinity of the partition wall 40, the toner detecting windows 44 are formed to be opposite to each other in a widthwise direction at the side walls 69L and 69R of the developing frame 36. The toner detecting windows 44 are formed by burying transparent circular plates in the respective side walls 69L and 69R of the developing frame 36 (see FIGS. 10 and 11).

Further, in the toner containing chamber 41, an agitator 45 for stirring the toner is provided. The agitator 45 includes an agitator rotation shaft 46 and a stirring member 47.

At almost the center of the toner containing chamber 41, the agitator rotation shaft 46 is supported on both side walls 69L and 69R of the developing frame 36 rotatably, and the stirring member 47 is provided on the agitator rotation shaft 46. Further, both shaft ends of the agitator rotation shaft 46 protrude outward from both side walls 69L and 69R, respectively.

At the time of development (at the time of forming images), a driving force from a motor (not shown) is applied to the agitator rotation shaft 46, and the agitator 45 is driven to rotate.

Further, the agitator 45 is provided with wipers 48. The wipers 48 are attached to both ends of the agitator rotation shaft 46 in an axial direction. If the agitator rotation shaft 46 rotates, the wipers 48 move in the toner containing chamber 41 in a circumferential direction on the basis of the agitator rotation shaft 46, and wipes the respective toner detecting windows 44 that are provided in both side walls 69L and 69R of the developing frame 36. As a result, the respective toner detecting windows 44 are cleaned by the wipers 48.

The developing chamber 42 is formed as an inner space of the rear side of the developing frame 36 that is partitioned by the partition wall 40.

In the developing chamber 42, the supply roller 37 is disposed on a central bottom wall 75 (which will be described in detail below) at the rear side of a communicating opening 43. The supply roller 37 includes a metallic supply roller shaft 50, and a sponge roller 51 that is provided at the circumference of the supply roller shaft 50 and made of a conductive foam material.

The supply roller shaft 50 is rotatably supported on both side walls 69L and 69R of the developing frame 36 in the developing chamber 42. Further, both shaft ends of the supply roller shaft 50 protrude outward from both side walls 69L and 69R, respectively.

At the time of development (at the time of forming images), a driving force from a motor (not shown) is applied to the supply roller shaft 50, and the supply roller 37 is driven to rotate. Further, at the time of development (at the time of forming images), the same bias as the developing bias applied to the developing roller 38 is applied to the supply roller 37.

In the developing chamber 42, the developing roller 38 is disposed on a rear bottom wall 76 (which will be described in detail below) at the rear side of the supply roller 37. The developing roller 38 is provided to come into contact with the supply roller 37 in a compressed state. The developing roller 38 includes a metallic developing roller shaft 52, and a rubber roller 53 serving as a developing roller member that is provided at the circumference of the developing roller shaft 52 and made of a conductive rubber material.

The developing roller shaft 52 extends parallel to the supply roller shaft 50, and it is rotatably supported on both side walls 69L and 69R of the developing frame 36 in the developing chamber 42. Further, both shaft ends of the developing roller shaft 52 protrude outward from both side walls 69L and 69R, respectively.

The rubber roller 53 is formed of conductive urethane rubber or silicon rubber that contains a carbon fine particle, and the surface of the rubber roller 53 is coated by a urethane rubber or silicon rubber coating layer that contains fluorine.

At the time of development (at the time of forming images), a driving force from a motor (not shown) is applied to the developing roller shaft 52, and the developing roller 38 is driven to rotate. Further, at the time of development (at the time of forming images), the developing bias is applied to the developing roller 38.

A layer-thickness regulating plate 39 includes a plate main body 54 that is formed of a metallic plate spring member, and a pressing portion 55 (having a semi-circular cross section) that is provided at a free end of the plate main body 54 and made of insulating silicon rubber. In the layer-thickness regulating plate 39, a base end of the plate main body 54 is supported to a plate attaching portion 77 (which will be described in detail below) by an attaching member 134 at an upper side of the developing roller 38. As a result, the free end of the plate main body 54 extends to the front side of the inclined lower side toward the supply roller 37, and the pressing portion 55 of the layer-thickness regulating plate 39 comes into contact with the developing roller 38 in a pressurized state by means of an elastic force of the plate main body 54.

(b-3) Developing Transfer Operation

At the time of forming images, if a driving force from a motor (not shown) is applied to the agitator rotation shaft 46, the agitator rotation shaft 46 rotates, and the stirring member 47 moves in the toner containing chamber 41 in a circumferential direction on the basis of the agitator rotation shaft 46. In this case, the toner contained in the toner containing chamber 41 is stirred by the stirring member 47, and discharged toward the developing chamber 42 from a communicating opening 43 that communicates in a forward-to-backward direction in the middle of a vertical direction of the partition wall 40.

When the supply roller shaft 50 rotates, the toner that is discharged from the communicating opening 43 to the developing chamber 42 is supplied to the rubber roller 53 of the developing roller 38 by means of a sponge roller 51 of the supply roller 37. At this time, the toner is frictionally charged with a positive polarity between the sponge roller 51 of the supply roller 37 and the rubber roller 53 of the developing roller 38. When the developing roller shaft 52 rotates, the toner supplied to a top surface of the rubber roller 53 of the developing roller 38 moves between the pressing portion 55 of the lay-thickness regulating plate 39 and the rubber roller 53 of the developing roller 38, and carried on the rubber roller 53 of the developing roller 38 as a thin layer having a predetermined thickness.

As shown in FIG. 2, if the photosensitive drum 28 rotates, first, the surface of the drum main body 33 is uniformly charged with a positive polarity by means of the scorotron charger 29, and then exposed by scanning a laser beam from the scanner unit 19 at high speed, thereby forming an electrostatic latent image corresponding to an image to be formed on the sheet 3.

Then, if the developing roller shaft 52 rotates, when the toner that is carried on the rubber roller 53 of the developing roller 38 and charged with a positive polarity is opposite to the surface of the drum main body 33 of the photosensitive drum 28 to come into contact with the photosensitive drum 28, the toner is supplied to the electrostatic latent image that is formed on the surface of the drum main body 33, that is, an exposed portion of a surface of the drum main body 33 that is uniformly charged with a positive polarity (which is exposed by a laser beam and whose potential is lowered). Accordingly, the electrostatic latent image of the drum main body 33 becomes a visible image, and on a surface of the drum main body 33, a toner image by a reversal development is carried.

Then, the toner image that is carried on the surface of the drum main body 33 is transferred to the sheet 3 by a transfer bias applied to the rubber roller 57 of the transfer roller 31 while the sheet 3 conveyed by the register roller 15 passes through a transfer location between the drum main body 33 and the rubber roller 57 of the transfer roller 31. The sheet 3 to which the toner image is transferred is conveyed to the fixing unit 21.

Further, a toner that remains on the surface of the drum main body 33 of the photosensitive drum 28 after the transfer is collected by the rubber roller 53 of the developing roller 38. Further, paper dusts of the sheet 3 that adheres on the surface of the drum main body 33 of the photosensitive drum 28 after the transfer are removed from the drum main body 33 of the photosensitive drum 28 by means of the cleaning brush 65 of the cleaning member 32.

(c) Fixing Unit

As shown in FIG. 1, the fixing unit 21 is provided on the rear side of the process cartridge 20, and disposed at a predetermined interval from the photosensitive drum 28 of the process cartridge 20 and in substantially parallel to the photosensitive drum 28. The fixing unit 21 includes a fixed frame 59, and a heating roller 60 and a pressurizing roller 61 that are provided in the fixed frame 59.

The heating roller 60 includes a metal tube whose surface is coated with a fluorine resin, and a halogen lamp for a heating process that is inserted into the metal tube. At the time of fixation (at the time of forming images), a driving force from a motor (not shown) is applied to the heating roller 60, and the heating roller 60 is driven to rotate.

Under the heating roller 60, the pressurizing roller 61 is disposed opposite to the heating roller 60 so as to press on the heating roller 60. The pressurizing roller 61 includes a metallic roller shaft, and a rubber roller that is made of a rubber material for covering the roller shaft. When the heating roller 60 is driven to rotate, the pressurizing roller 61 is driven.

The fixing unit 21 fixes thermally the toner image transferred to the sheet 3 at the transfer location while the sheet 3 passes between the heating roller 60 and the pressurizing roller 61. The sheet 3 to which the toner image is fixed is conveyed to the discharge tray 62 that is formed on a top surface of the main body casing 2.

The sheet-discharge-side conveyance path of the sheet 3 from the fixing unit 21 to the discharge tray 62 is bent toward a front side from the fixing unit 21 in a substantially U shape. In the middle of the sheet-discharge-side conveyance path, the conveyance roller 63 is provided, and at the downstream side end, sheet discharge rollers 64 are provided.

The sheet 3 that is thermally fixed in the fixing unit 21 is conveyed along the sheet-discharge-side conveyance path, then conveyed to the sheet discharge rollers 64 by the conveyance roller 63, and then discharged on the discharge tray 62 by means of the sheet discharge rollers 64.

2. Detail of Developing Cartridge

Figure 5:
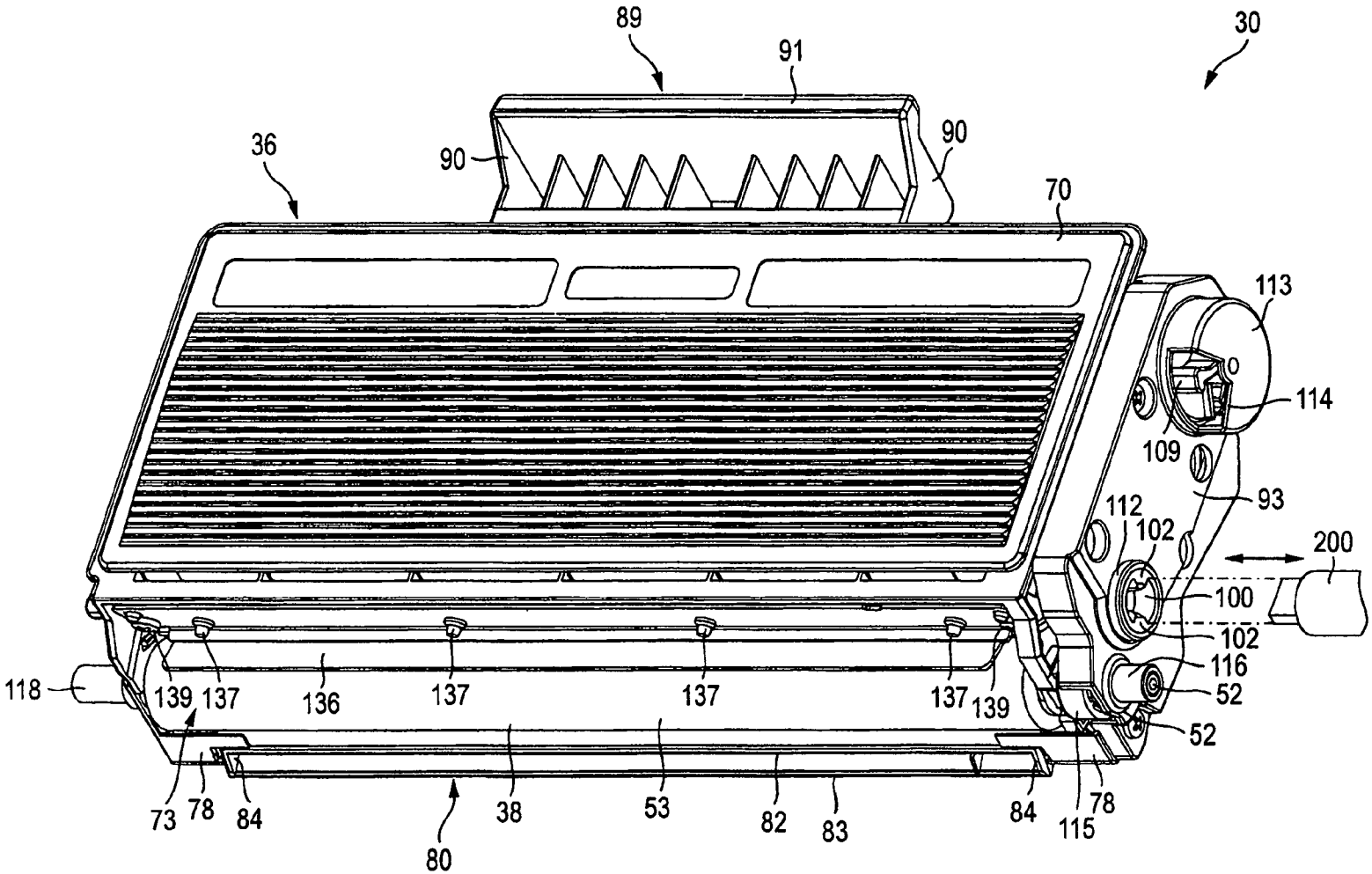
FIG. 5 is a perspective view illustrating the developing cartridge, viewed from a rear upper left side.
Figure 6:
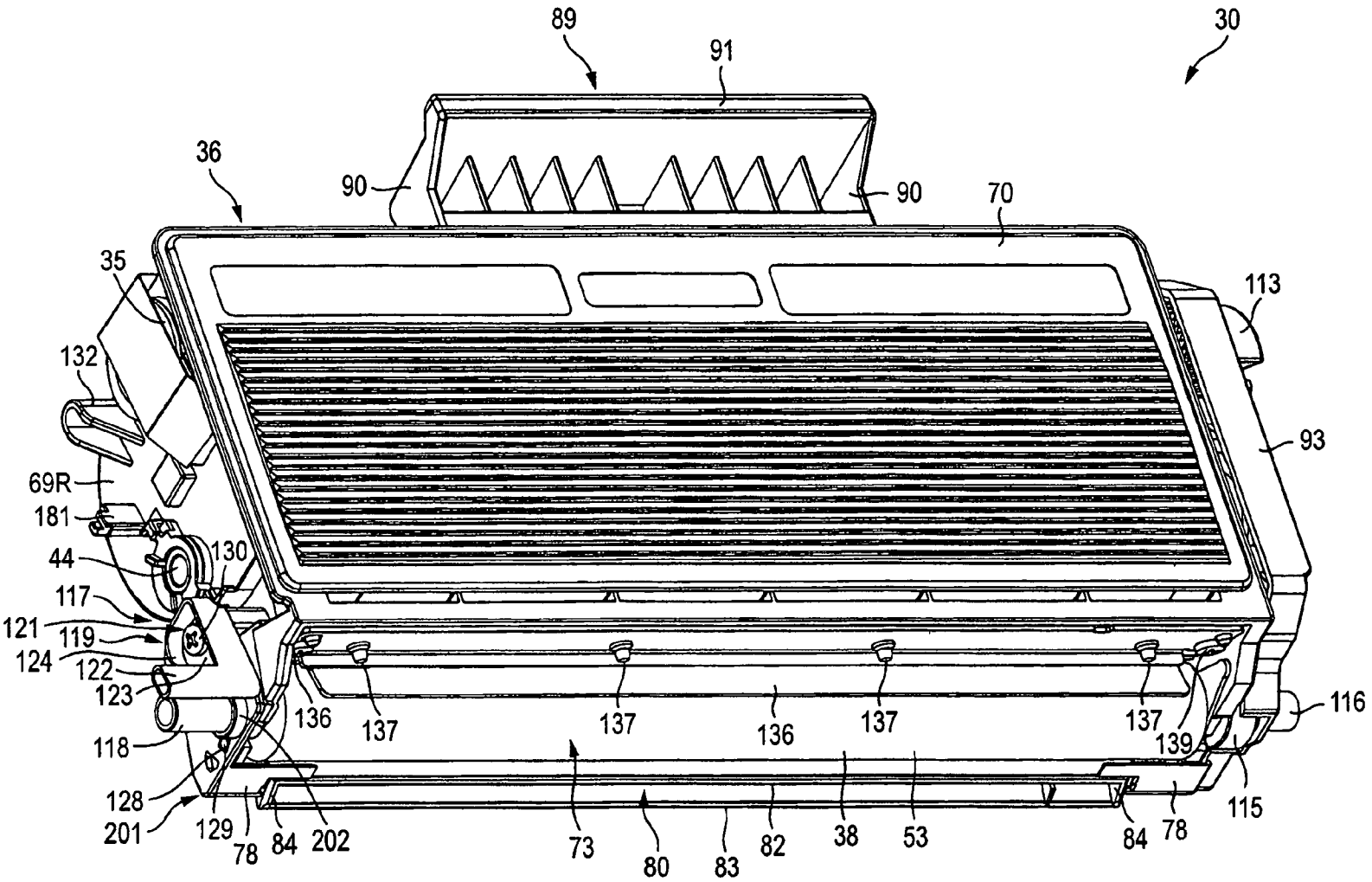
FIG. 6 is a perspective view illustrating the developing cartridge (a state in which an electrode member is mounted), viewed from a rear upper right side.
Figure 7:
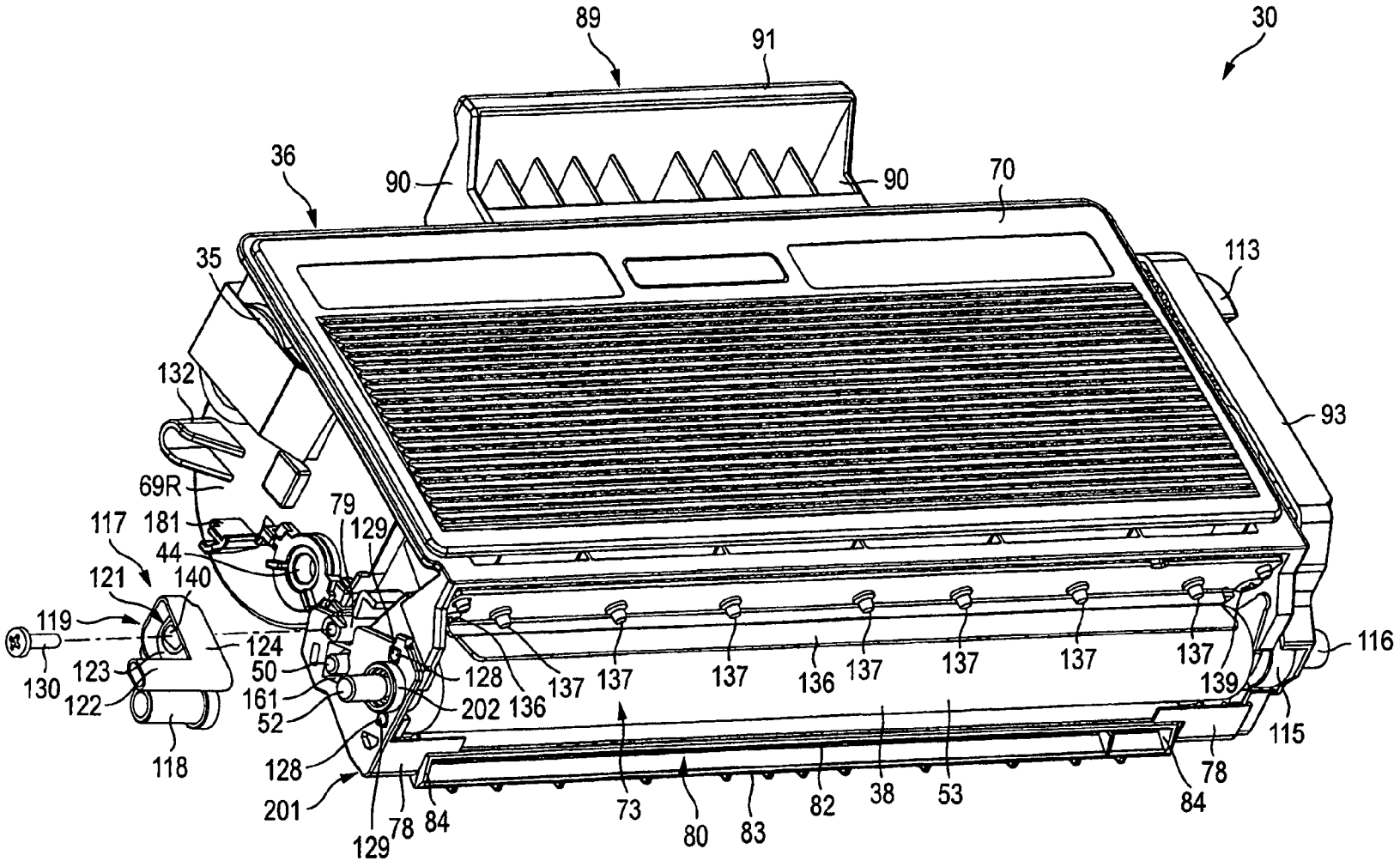
FIG. 7 is a perspective view illustrating the developing cartridge (a state in which the electrode member is not mounted), viewed from a rear upper right side.
Figure 8:
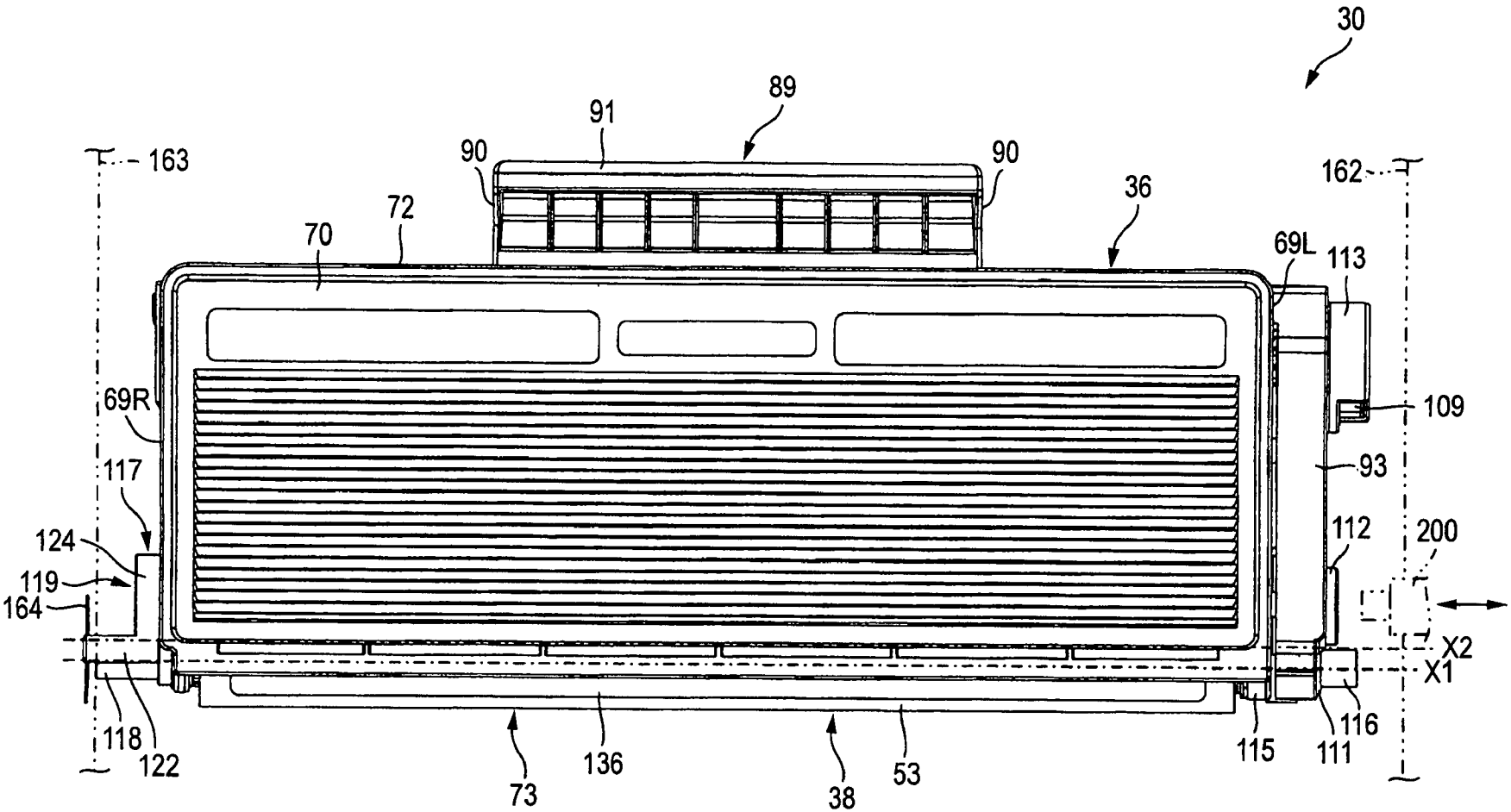
FIG. 8 is a plan view illustrating the developing cartridge.
Figure 9:
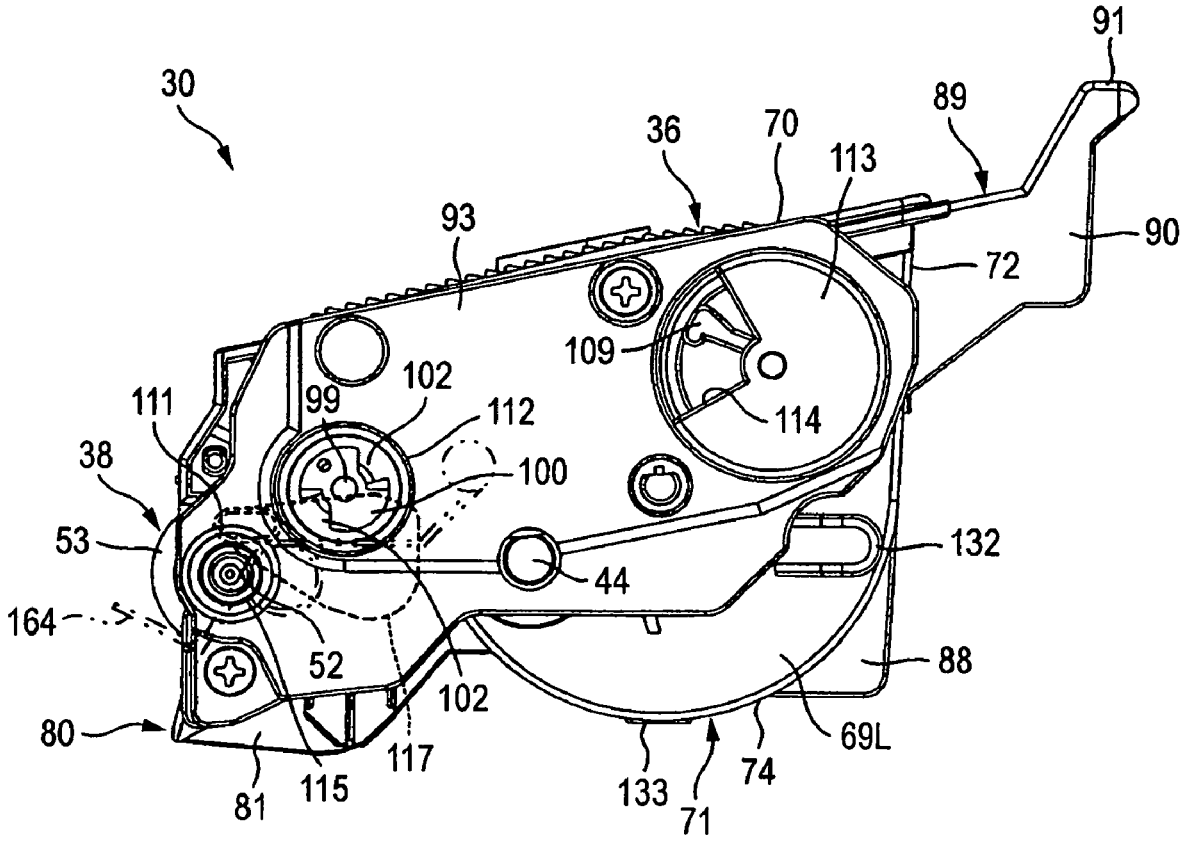
FIG. 9 is a left side view illustrating the developing cartridge (a state in which a gear cover is mounted)
Figure 10:
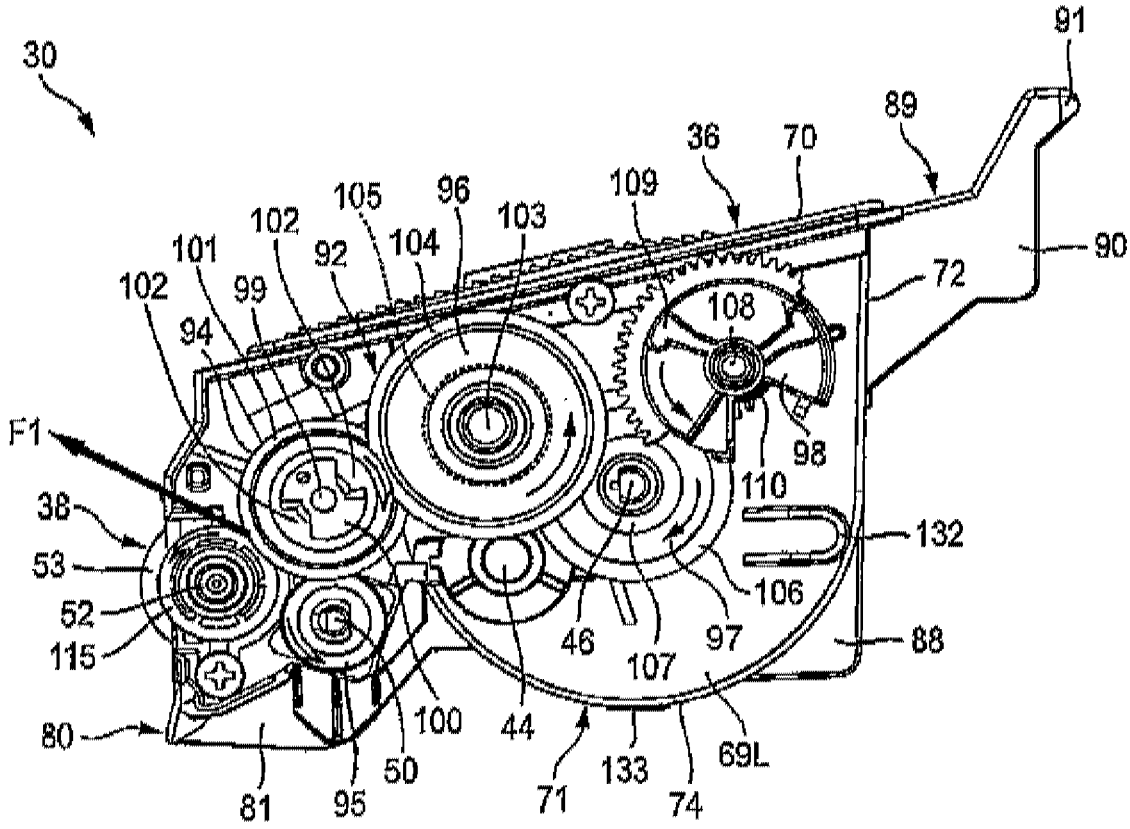
FIG. 10 is a left side view illustrating the developing cartridge (a state in which the gear cover is not mounted)
Figure 11:
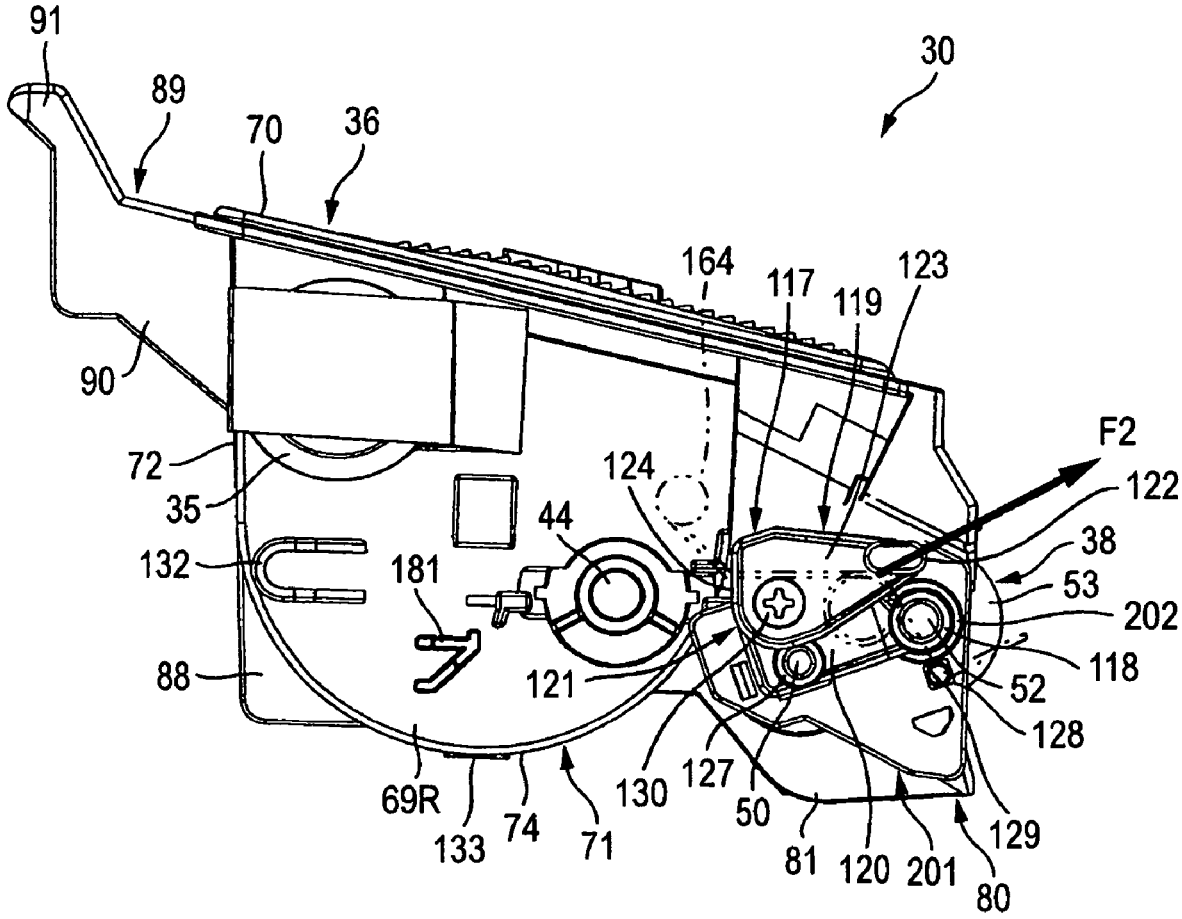
FIG. 11 is a right side view illustrating the developing cartridge.

FIG. 5 is a perspective view illustrating the developing cartridge, viewed from the upper left of the rear side, FIG. 6 is a perspective view illustrating the developing cartridge, viewed from the upper right of the rear side (a state in which an electrode member is mounted), FIG. 7 is a perspective view illustrating the developing cartridge , viewed from the upper right of the rear side (a state in which the electrode member is not mounted), FIG. 8 is a plan view illustrating the developing cartridge, FIG. 9 is a left side view of the developing cartridge (a state in which a gear cover is mounted), FIG. 10 is a left side view of the developing cartridge (a state in which the gear cover is not mounted), and FIG. 11 is a right side view illustrating the developing cartridge. Hereinafter, the developing cartridge will be described in detail with reference to FIGS. 4 to 11.

(1) Developing Frame

As shown in FIGS. 4 and 5, the developing frame 36 includes a pair of side walls 69L and 69R, an upper wall 70, a bottom wall 71, and a front wall 72 that are integrally provided. The rear side of the developing frame 36 is provided with a rear-side opening 73 serving as an opening, and the developing frame has a box shape.

Each of the side walls 69L and 69R forms a flat shape. As shown in FIG. 8, the side walls 69L and 69R are disposed opposite to each other in a widthwise direction with the toner containing portion 41 and the developing chamber 42 interposed therebetween. As shown in FIGS. 10 and 11, both sides of the toner containing chamber 41 and the developing chamber 42 are covered.

As shown in FIGS. 4 and 8, the top wall 70 forms a flat shape, and connected to upper ends of the side walls 69L and 69R and disposed over a region between the side walls 69L and 69R. The top wall 70 covers the top surfaces of the toner containing chamber 41 and the developing chamber 42.

As shown in FIG. 4, the bottom surface 71 forms a curved plate shape, connected to the lower ends of the side walls 69L and 69R, and disposed over a region between the side walls 69L and 69R. The bottom wall 71 covers the bottom surfaces of the toner containing chamber 41 and the developing chamber 42, and has a front bottom wall 74, a central bottom wall 75, and a rear bottom wall 76 that are integrally formed.

The front bottom wall 74 is formed to have a cross section of a substantially semi-circular arc shape in accordance with the rotation trace of the agitator 45 in the toner containing chamber 41.

The central bottom wall 75 is deposed on the rear side of the front bottom wall 74, and has a cross-section of a substantially semi-circular arc shape in accordance with the supply roller 37 of the developing chamber 42.

The rear bottom wall 76 is disposed on the rear side of the central bottom wall 75, and has a tongue plate shape is inclined downward from the front side to the rear side.

The front wall 72 forms a flat plate shape, and it is connected to the front ends of both side walls 69L and 69R and disposed over a region between both side walls 69L and 69R. The front wall 72 closes the front of the toner containing chamber 41.

Further, as shown in FIG. 4, on the rear ends of both side walls 69L and 69R, a blade installing portion 77 is installed.

The blade installing portion 77 is installed between the side walls 69L and 69R. The blade installing portion 77 is formed in a such a manner that a side cross section becomes narrower downward to form a triangular shape, and a rear end face is inclined to the front side of the inclined downward direction from an upper end to a lower end.

Further, as shown in FIGS. 4 and 5, on the rear end face of the blade installing portion 77, a base end of the plate main body 54 is fixed by an installing member 134 with a sealing member 135 interposed between the rear end face and the base end of the plate main body 54.

The sealing member 135 is disposed on a rear end face of the blade installing portion 77, and prevents the toner from being leaked between the rear end face and the installing member 134.

The installing member 134 includes a front support member 138 having a flat shape, a back support member 136 having a substantially L-shaped cross section, and an installing screw 137. The front support member 138 is disposed on the rear side of the sealing member 135. The base end of the plate main body 54 is disposed on the rear side of the front support member 138, and the back support member 136 is disposed on the rear side of the base end of the plate main body 54. The installing screw 137 penetrates the back support member 136, the base end of the plate main body 54, and the front support member 138 in a forward-to-backward direction, and fixes the back support member 136, the base end of the plate main body 54, and the front support member 138 to be integrated with one another. The base end of the plate main body 54 is fixed to the blade installing portion 77 by means of the fixing screw 139 with the installing member 134 and the sealing member 135 interposed therebetween.

The rear-side opening 73 is defined by the back support member 136 of the installing member 134, the rear ends of the side walls 69L and 69R, and the rear ends of the rear bottom wall 76, and extends in a widthwise direction and opens in a rectangular shape.

In the rear opening 73, the developing roller 38 is disposed to be partially exposed. Specifically, as shown in FIG. 9, the developing roller 38 is disposed such that, in a side view, its first half portion is accommodated in the developing frame 36, and its second half portion protrudes toward an outer side of the developing frame 36 from an inner portion of the developing frame 36 through the a rear opening 73.

Further, as shown in FIG. 8, the developing roller 38 is supported such that shaft ends of the developing roller shaft 52 can rotate at the side walls 69L and 69*r* that are opposite to each other.

In the shaft end of the developing roller shaft 52 that protrudes from one side wall 69 (hereinafter, it is referred to as a left wall 69L), a collar member 116 is externally fitted. The shaft end of the developing roller shaft 52 is inserted into a developing roller shaft inserting portion 111 of the gear cover 93 adjacent to the right wall 69 together with collar member 116, which is shown in FIG. 5 and will be described in detail below. The developing roller shaft 52 is supported to the developing roller shaft inserting portion 111 of the gear cover 93 rotatably.

In the shaft end of the developing roller shaft 52 protruding from the other side wall 69 (hereinafter, referred to as a right wall 69R), as shown in FIG. 7, a bearing member 201 adjacent to the right wall 69R is externally fitted, and the shaft end of the developing roller shaft 52 penetrates the bearing member 201.

Further, the electrode member 117 is provided to be adjacent to the bearing member 201. In the shaft end of the developing roller shaft 52 that has penetrated the bearing member 201, a developing roller shaft covering portion 118 that is formed on the electrode member 117 is externally fitted. The developing roller shaft 52 is fixed to the developing roller shaft covering portion 118 of the electrode member 117 rotatably.

Thereby, both ends of the developing roller 38 are fixed by the developing roller shaft inserting portion 111 of the gear cover 93, and the developing roller shaft covering portion 118 of the electrode member 117.

Further, as will be described in detail below, when the collar member 116 and the developing roller shaft covering portion 118 are mounted on the developing cartridge mounting portion 147 of the developing cartridge 30, they are guided to grooves 153 (see FIG. 3) formed in both side walls 144 of the developing cartridge mounting portion 147. As a result, it is possible to ensure smooth mounting of the developing cartridge 30 on the developing cartridge mounting portion 147.

Further, in the rear end of the rear bottom wall 76 that is disposed below the rear opening 73, side end rear walls 78 are provided at both ends in a widthwise direction, as shown in FIGS. 4 and 5. The side end rear walls 78 are formed in a substantially L shape such that inner portions of the lower portions in a widthwise direction are notched.

Further, at a rear end of the rear bottom wall 76 that is disposed below the rear opening 73, a reinforcing portion 80 is provided between the side end rear walls 78.

The reinforcing portion 80 is provided such that it extends in a widthwise direction between the side end rear walls 78, and it is fitted into a notched portion of each of the side end rear portions 78. The reinforcing portion 80 is formed to be continuous to the rear end of the rear side bottom wall 76, and includes a reinforcing top wall 82, a reinforcing front wall 85, a reinforcing bottom wall 83, and reinforcing side walls 84 that are integrally formed. In addition, the rear side of the reinforcing portion 80 is opened and formed in a box shape. Specifically, the reinforcing portion 80 is formed such that a cross section of the reinforcing portion 80 in a direction orthogonal to a widthwise direction a substantially U shape in which a rear side is opened.

The reinforcing top wall 82 is provided such that it is continuous to the rear end of the rear bottom wall 76, and protrudes rearward.

The reinforcing front wall 85 is provided such that it is continuous to the rear end of the rear bottom wall 76 and extends downward from the front end of the reinforcing top wall 82.

The reinforcing bottom wall 83 is provided in such a manner that it is disposed to be opposite to the reinforcing top wall 82 in a vertical direction, continuous from the lower end of the reinforcing front wall 85, and extends downward at the inclined rear side.

The reinforcing side walls 84 are provided such that they are continuous to both ends of the reinforcing front wall 85 and the reinforcing bottom wall 83 in a widthwise direction.

Further, as shown in FIG. 4, on the reinforcing top wall 82, a lower film 87 coheres. The lower film 87 is made of a material of polyethyleneterephthalate. In a state in which the rear end of the lower film 87 coheres on the top surface of the reinforcing top wall 82, the front end of the lower film 87 extends upward at the inclined front side. In addition, the lower film 87 is disposed to come into contact with the bottom surface of the rubber roller 53 of the developing roller 38. Thereby, the lower film 87 closes a gap between the reinforcing top wall 82 and the developing roller 38 such that it prevents the toner from being leaked from the gap.

Further, on the bottom wall 71 of the developing frame 36, a plurality of guide plates 81 are provided to be continuous to the reinforcing portion 80. The guide plate forms a rib shape (flat shape) to extend in a forward-to-backward direction and protrudes downward from the bottom wall 71. The guide plates are disposed to be parallel to each other at predetermined intervals in a widthwise direction.

Specifically, in each of the guide plates 81, a rear end is connected to the reinforcing front wall 85 and the reinforcing bottom wall 83, and a front end is connected to the rear end of the front bottom wall 74 and erected downward from the rear bottom wall 76 and the central bottom wall 75. Further, the lower end of the guide plate 81 extends from the rear end of the reinforcing bottom wall 83 toward the front, and it is slightly bent on the inclined front side, and reaches to the rear end of the front bottom wall 74.

Further, as shown in FIGS. 9 and 11, in the front bottom wall 74, a loading portion 133 and a loading plate 88 are provided for loading the developing cartridge in the cartridge containing portion 147 of the drum frame 58.

The loading portions 133 are respectively formed at both side ends in a widthwise direction at the center of the forward-to-backward direction of the front bottom wall 74. Each loading portion 133 is formed of a thick plate having a rectangular shape when viewed from a bottom surface, and it is provided on the bottom surface of the front bottom wall 74.

A pair of lading plates 88 that are disposed to be opposite to each other in a widthwise direction form one set, and they are respectively formed at both ends in a widthwise direction at the front end of the front bottom wall 74. Each of the loading plates 88 forms a triangle shape in a side view, and it is erected downward from the front bottom wall 74. The lower end edge of the loading plate 88 is formed to extend in a forward-to-backward direction at a position slightly higher than the loading portion 133.

Further, as shown in FIGS. 4 and 8, on the front wall 72 of the developing frame 36, a holding portion 89 is provided. The holding portion 89 is formed in a substantially U shape in a side view, and at the front wall 72, it has two handle supporting plates 90 that are disposed at a predetermined interval in a widthwise direction, and a handle 91 that is installed between the two handle supporting plates 90. Each of the handle supporting plates 90 is formed such that it has a flat shape, and protrudes forward from the upper side of the front wall 72. The handle 91 is connected to the front end edge of each handle supporting plate 90.

Further, as shown in FIGS. 9 and 11, at the side walls 69L and 69R of the developing frame 36, bosses 132 are respectively provided. In a state in which the developing cartridge 30 is mounted on the cartridge mounting portion 147 of the drum frame 58, each boss 132 comes into contact with each pressing lever 150.

The respective bosses 132 are provided such that they protrude outward from an outer surface of the lower front ends of the side walls 69L and 69R. Each of the bosses 132 is formed in a U shape in a side view so as to open in a rearward direction, and they are disposed at locations where the two bosses are symmetrical to each other in a widthwise direction.

As shown in FIG. 11, in the right wall 69R, an engagement portion 181 is provided such that it protrudes outward from the right wall 69R.

Further, as shown in FIG. 7, in the right wall 69R that closes the developing chamber 42, a screw cylindrical portion 79 for fixing the electrode member 117 to be described in detail below is provided. The screw cylindrical portion 79 is provided such that it forms a circular shape, and protrudes outward from the right wall 69R in a widthwise direction 69R. Further, an upper end and a lower end are notched in a forward-to-backward direction, so that a free end of the screw cylindrical portion 79 is a substantially elliptical shape where portions parallel to each other in a forward-to-backward direction are formed.

(2) Gear Mechanism Portion and Gear Cover

Further, in the developing frame 36, in the left wall 69L, as shown in FIG. 10, shaft ends of the agitator rotation shaft 46, the supply roller shaft 50, and the developing roller shaft 52 protrudes outward from the left wall 69L in a widthwise direction.

In the left wall 69L, a gear mechanism portion 92 that drives the agitator rotation shaft 46, the supply roller shaft 50, and the developing roller shaft 52 to rotate, and a gear cover 93 for covering the gear mechanism portion 92 as shown in FIGS. 5 and 6 are provided.

As shown in FIG. 10, the gear mechanism portion 92 is disposed in a left wall 69L. The gear mechanism portion 92 includes an input gear 94 serving as a driving force transmitting unit, a supply roller driving gear 95, a developing roller driving gear 115 serving as a developing roller gear, an intermediate gear 96, an agitator driving gear 97, and a detecting gear 98.

The input gear 94 is supported to an input gear supporting shaft (not shown) protruding outward from the left wall 69L in a widthwise direction rotatably, between the developing roller shaft 52 and the agitator rotation shaft 46.

The input gear 94 includes a coupling passive portion 100 that serves as a driven rotator, and a driving gear 101 serving as a transmitting gear that is provided on the same rotation axis line as the coupling passive portion 100. The coupling passive portion 100 and the driving gear 101 are integrally formed.

The coupling passive portion 100 forms a hollow cylindrical shape, and a pair of engagement claws that engage with a coupling driving portion 200 (see FIG. 5, which will be described in detail below) from an inner circumferential surface and protrudes an inward direction of a diameter direction. The engagement claws 102 are disposed to be opposite to each other on the basis of the rotation shaft 99.

The driving gear 101 is adjacent to an inner side of the coupling passive portion 100 in a widthwise direction, and disposed between the coupling passive portion 100 and the left wall 69L.

Under the input gear 94, the supply roller driving gear 115 engages with the driving gear 101, and it is provided to the shaft end of the developing roller shaft 52 so as to rotate integrally with the developing roller 52.

Under the inclined rear side of the input gear 94, the developing roller driving gear 115 engages with the driving gear 101, and it is provided to the shaft end of the developing roller shaft 52 so as to rotate integrally with the developing roller shaft 52.

In front of the input gear 94, the intermediate gear 96 is supported to the intermediate gear supporting shaft 103 protruding from the left wall 69L in an outward direction of a widthwise direction so as to freely rotate. The intermediate gear 96 includes an external tooth 104 that engages with the input gear 94, and an internal tooth 105 that is disposed on an inner side of the external tooth 104 in a widthwise direction and engages with the agitator driving gear 97, which are integrally provided.

Under the inclined front side of the intermediate gear 96, the agitator driving gear 97 is provided to the shaft end of the agitator rotation shaft 46 so as to integrally rotate with the agitator rotation shaft 46. The agitator driving gear 97 includes an internal tooth 106 that engages with an inner tooth 105 of an intermediate gear 96, and an external tooth 107 that is disposed on an inner side of the internal tooth 106 in a widthwise direction and engages with the detecting gear 98.

On the inclined front side of the agitator driving gear 97, the detecting gear 98 is supported to the detecting gear supporting shaft 108 protruding from the left wall R69 in an outward direction of the widthwise direction rotatably.

The detecting gear 98 is made of a notched tooth gear in which a gear tooth provided at the outer circumference is partially notched. In the detecting gear 98, a new product determining protrusion 109 extending from the detecting gear supporting shaft 108 in an outward direction of a diameter direction is integrally formed. Further, the detecting gear 98 is urged by a coil spring 110 wound in the detecting gear supporting shaft 108 such that it engages with the outer tooth 107 of the agitator driving gear 97.

As shown in FIG. 9, the gear cover 93 is installed in the left wall 69L of the developing cartridge 30 so as to cover the gear mechanism portion 92 in an outward direction of a widthwise direction. In the gear cover 93, a developing roller shaft inserting portion 111 in which the developing roller shaft 52 and the collar member 116 are inserted in the front side of the developing roller shaft inserting portion 111, and an input opening portion 112 for exposing the coupling passive portion 100 are formed. Further, at the front side of the gear cover 111, a detecting gear covering portion 113 for covering the detecting gear 98 is formed.

The detecting gear cover portion 113 is formed to expand in an outward direction of the widthwise direction, and the detecting gear 98 is contained in the expansion portion. In the rear side portion of the detecting gear cover portion 113, opened is a detection widow 114 for exposing the new product determining protrusion 109 moving in a circumferential direction when the detecting gear 98 rotates.

(3) Electrode Member

As shown in FIG. 7, in the right wall 69R of the developing frame 36, a bearing member 201 that supports the shaft end of the developing roller shaft 52 is provided. The bearing member 201 is formed of a flat non-conductive resin, and at the rear end of the bearing member 201, a collar member 202 that has an inner diameter having almost the same size as that of an outer diameter of the developing roller 52 is integrally formed. The collar portion 202 forms a cylindrical shape, and the developing roller shaft 52 is inserted into the collar portion 202. The shaft end of the developing roller shaft 52 is supported on an inner circumferential surface of the collar portion 202 slidably and rotatably.

At a rear portion of the bearing member 201, two fitting holes 128 are formed with the collar portion 202 interposed therebetween. At a front end of the bearing member 201, an opening 161 is formed. At locations of the right wall 69R that is opposite to the fitting holes 128, two fitting protrusions 129 are formed.

The bearing member 201 is attached to the right wall 69R at the location where the rear end edge of the bearing member 201 flushes with the rear end edge of the right wall 69R. In a state in which the bearing member 201 is attached to the right wall 69R, the developing roller shaft 52 is inserted into the collar portion 202, and the supply roller shaft 50 communicates with the opening 161. As a result, the two fitting protrusions 129 are respectively fitted into the fitting holes 128.

Further, In the bearing member 201, in order to avoid interference with the screw cylindrical portion 79 protruding from the right wall 69R in an outward direction of a widthwise direction, an outer circumferential end edge of the bearing member 201 is notched at the location where the screw cylindrical portion 79 is provided. In a state in which the bearing member 201 is attached to the right wall 69R, the screw cylindrical portion 79 is exposed from an outer circumferential end edge of the bearing member 201.

On a surface of the bearing member 201, an electrode member 117 for supplying a developing bias to the developing roller shaft 52 is provided.

The electrode member 117 is formed of a conductive resin containing a carbon fine particle. As shown in FIGS. 7 and 11, the electrode member 117 includes an attachment plate 120, a developing roller shaft covering portion 118 serving as a developing roller supporting portion that is provided on the attachment plate 120, and a terminal portion 119, which are integrally provided.

The attachment plate 120 forms a flat shape, and it is formed in a substantially rectangular shape in a side view.

The developing roller shaft covering portion 118 is provided on the rear end of the attachment plate 120, and forms a concentric cylindrical shape with the collar portion 202 Further, the developing roller shaft covering portion 118 is formed to protrude from the rear end of the attachment plate 120 in an outward direction of the widthwise direction.

The shaft end of the developing roller shaft 52 has a large diameter portion that is supported on the collar portion 202, and a small diameter portion that is supported on the developing roller shaft covering portion 118. A diameter of the large diameter portion is larger than that of the small diameter portion. Further, an outer diameter of the developing roller shaft covering portion 118 is formed to have the same size as that of the inner diameter of the collar portion 202. When the developing roller shaft 52 is inserted into the developing roller shaft covering portion 118, a portion of the developing roller shaft covering portion 118 is disposed in a cylinder of the collar portion 202.

On the inclined front side of the developing roller shaft covering portion 118, the terminal portion 119 is provided on an upper end of the attachment plate 120. The terminal portion 119 has a pedestal portion 121, and a contact protruding portion 122 serving as a contact portion, which are integrally provided.

The pedestal portion 121 includes a base plate 123 that is tapered from a front side to a rear side and forms a triangular shape in a side view, and a ring-shaped outer frame plate 124 that protrudes in an outward direction of a widthwise direction, which are integrally provided. The outer frame plate 124 that is provided along the upper end of the pedestal portion 121 is formed in a forward-to-backward direction. The outer frame plate 124 that is provided along the lower end of the pedestal portion 121 is formed to be inclined upward from the front side to the rear side. The outer frame plate 124 that is provided along the front end of the pedestal portion 121 is formed in a vertical direction.

Further, in the base plate 123 of the pedestal portion 121, a screw inserting hole 140 is formed in almost a central portion of the base plate 123. The screw inserting hole 140 is a substantially elliptical shape such that portions parallel to each other in a forward-to-backward direction are formed to correspond to the loose end of the screw cylindrical portion 79.

The contact point protruding portion 122 is provided such that it is disposed on a rear end of the base plate 123, and protrudes from the rear end in an outward direction of a width-wise direction. The contact point protruding portion 122 is a cylinder having a cross section with an elliptical shape such that a long diameter direction is toward a forward-to-backward direction. The contact point protruding portion 122 is formed such that its base end is continuous to an outer frame plate 124 that is provided along an upper end and a lower end of the pedestal 121.

The contact point protruding portion 122 is disposed such that its rear end overlaps the developing roller shaft covering portion 118 in a vertical direction (that is, as shown in FIG. 8, the developing roller shaft covering portion 118 is disposed such that in a vertical direction, its front portion overlaps the contact point protruding portion 122, and its rear portion is exposed from the contact point protruding portion 122). Further, the contact point protruding portion 122 is disposed such that its free end protrudes more in an outward direction of a widthwise direction than the free end of the developing roller shaft covering portion 118 (that is, as shown in FIG. 8, the developing roller shaft covering portion 118 is disposed such that in the widthwise direction, its outer end face of a widthwise direction is more toward an inward direction of a widthwise direction than an outer end face of a widthwise direction of the contact point protruding portion 122).

Further, in the attachment plate 120, the supply roller shaft covering portion 127 is provided. At the front end of the attachment plate 120, the supply roller shaft covering portion 127 is provide data lower portion of the terminal portion 119. The supply roller shaft covering portion 127 forms a cylindrical shape such that the shaft end of the supply roller shaft 50 is inserted. The supply roller shaft covering portion 127 is formed such that it protrudes in an outward direction of a widthwise direction at a shorter distance than the outer fame plate 124.

The shaft end of the developing roller shaft 52 is inserted into the developing roller shaft covering portion 118 to support the developing roller shaft 52, the shaft end of the supply roller shaft 50 is inserted into the supply roller shaft covering portion 127 to support the supply roller shaft 50, a screw 130 is inserted into the screw inserting hole of the base plate 123, and the screw 130 is screwed to the screw cylindrical portion 79 of the right wall 69R. In this way, the electrode member 117 is installed in the right wall 69R.

Accordingly, the shaft end of the developing roller shaft 52 comes into contact with an inner circumferential surface of the developing roller shaft covering portion 118 slidably. Also, the shaft end of the supply roller shaft 50 comes into contact with an inner circumferential surface of the supply roller shaft covering portion 127.

3. Main Body Casing

Figure 12:
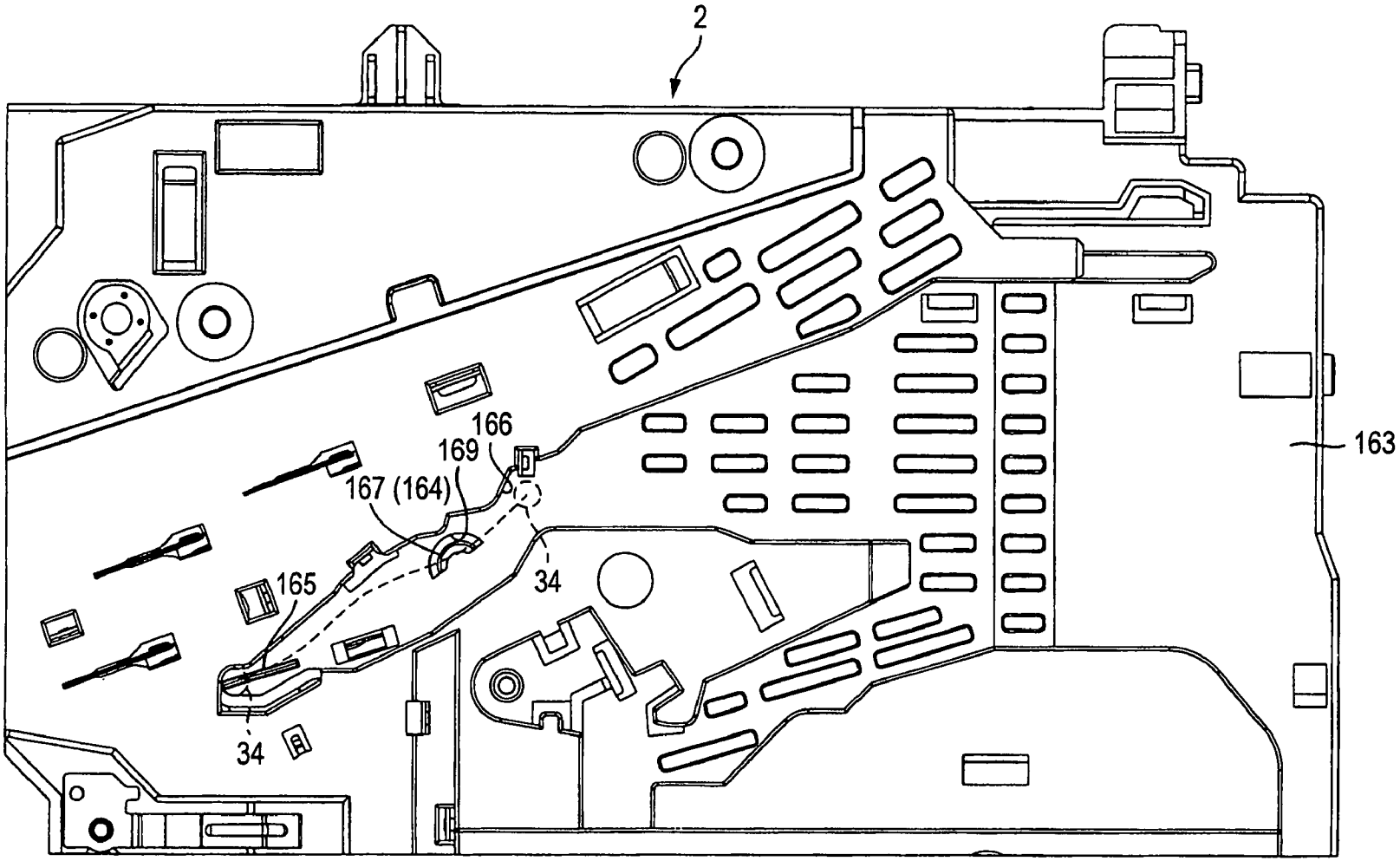
FIG. 12 is a side view illustrating an inside surface of a right wall of a process cartridge containing portion of a main body casing.
Figure 13:
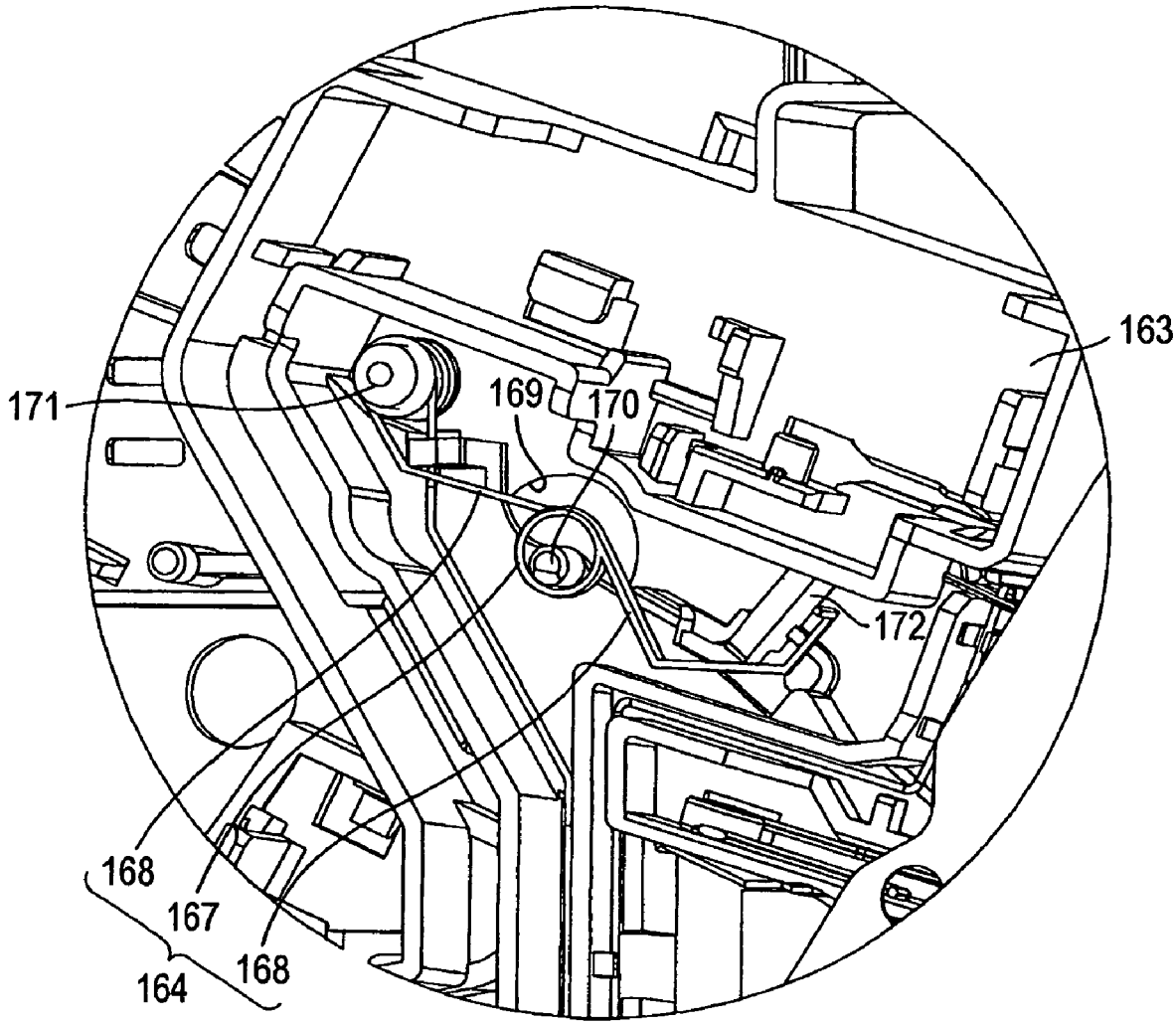
FIG. 13 is an enlarged view illustrating a main portion of an outside surface of the right wall shown in FIG. 12 (a state in which the developing cartridge is not mounted)
Figure 14:
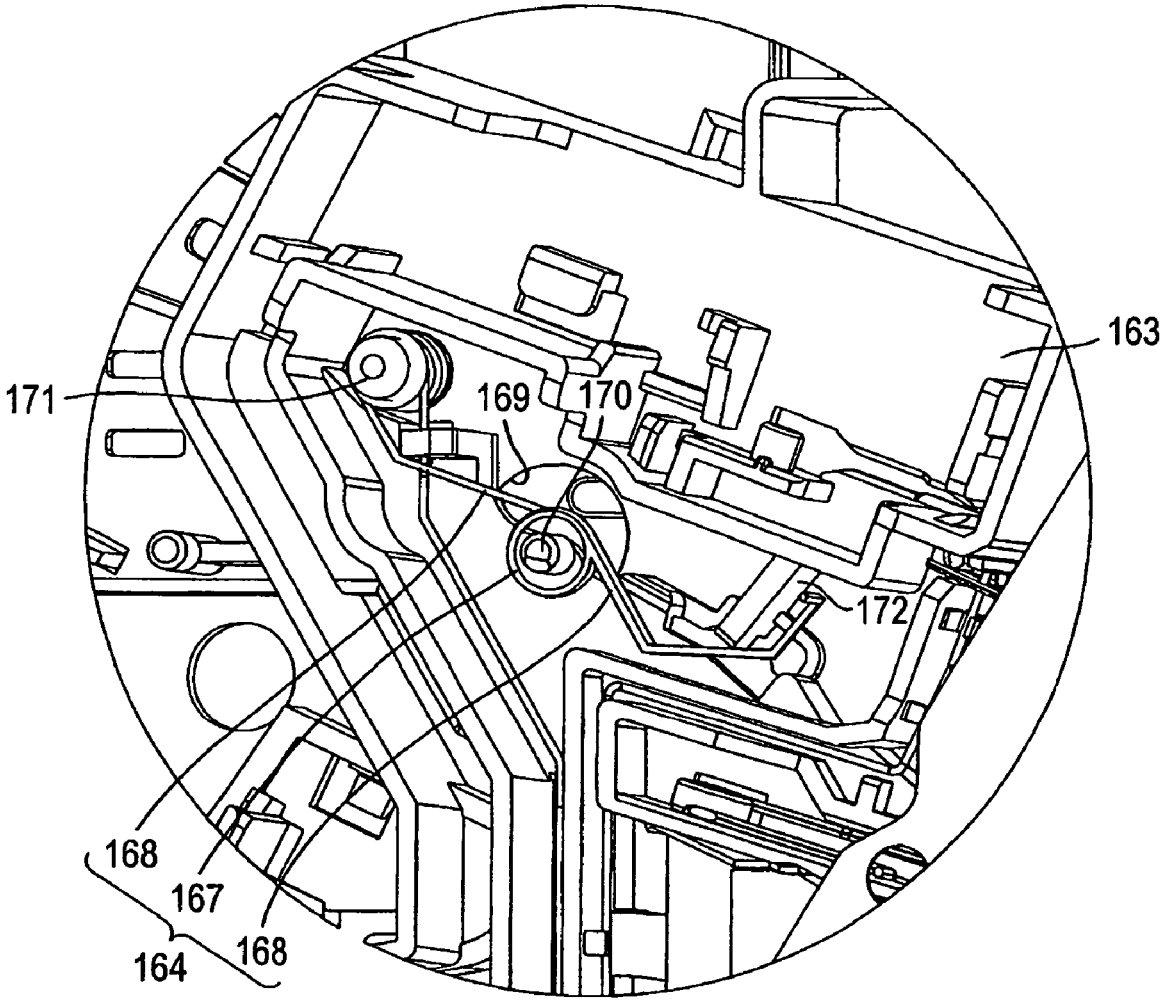
FIG. 14 is an enlarged view illustrating a main portion of an outside surface of a right wall shown in FIG. 12 (a state in which the developing cartridge is mounted).

FIG. 12 is a side view illustrating an inner surface of a right wall of a process cartridge containing portion of the main body casing. FIG. 13 is an enlarged view of the outer surface of a right wall shown in FIG. 12 (a state in which the developing cartridge is not mounted). FIG. 14 is an enlarged view of the outer surface of a right wall shown in FIG. 12 (a state in which the developing cartridge is mounted).

(1) Process Cartridge Containing Portion

As shown in FIGS. 1 and 8, the process cartridge containing portion 6 is formed as an inner space between a right wall 162 and a left wall 163 of a main body casing 2 disposed to be opposite to each other at a predetermined interval in a widthwise direction, between a feeder portion 4 and a scanner unit 19 in the main body casing 2.

In an inner surface of the right wall 163, as shown in FIG. 12, a guide groove 166 is formed to guide attachment and detachment of the process cartridge 20. In order to receive a drum shaft 34 of the photosensitive drum 28 slidably, the guide groove 166 is provided in a forward-to-backward direction to be recessed from the inner surface of the right wall 163 to an outward direction of a widthwise direction. Further, the guide groove 166 has a front end edge that is opened, and it is formed in a triangular shape in a side view to be gradually narrower in a backward direction. In the innermost portion (rear end), a ground electrode 165 that comes into contact with the drum shaft 34 of the photosensitive drum 28 is provided.

Further, the guide groove 166 is formed to have the same shape on an inner surface of the left wall 162 (see FIG. 8) that is opposite to the right wall 163.

Further, in the process cartridge containing portion 6, in the right wall 162, a coupling driving portion 200 serving as a driving rotator is provided. A developing bias applying electrode 164 is provided in the right wall 163.

(2) Coupling Driving Portion

As shown in FIGS. 5 and 8, the coupling driving portion 200 is disposed on the left wall 162. If the process cartridge 20 in which the developing cartridge 30 is mounted is mounted in the process cartridge containing portion 6, it is disposed to be opposite to the coupling passive portion 100 of the input gear 94 of the developing cartridge 30 in a widthwise direction.

The coupling driving portion 200 is inserted into the coupling passive portion 100 to freely progress or retreat in an arrow direction of FIGS. 5 and 8 in a state in which it is interlocked with the opening or closing of the front cover 7 of the main body casing 2. That is, if the front cover 7 is opened, the coupling driving portion 200 retreats from the coupling passive portion 100. Thereby, the process cartridge 20 can be detached from the process cartridge containing portion 6. On the other hand, after the process cartridge 20 in which the developing cartridge 30 is mounted is mounted in the process cartridge containing portion 6, if the front cover 7 is closed, the coupling driving portion 200 progresses to the coupling passive portion 100, and is coupled with the coupling passive portion 100.

Further, at the time of development (at the time of forming images), the coupling driving portion 200 is applied with a driving force from a motor (not shown) that is provided in the main body casing 2. If the coupling passive portion 100 is coupled with the coupling driving portion 200, the coupling driving portion 200 engages with an engagement claw 102, so that the coupling passive portion 100 and the coupling driving portion 200 can integrally rotate.

(3) Developing Bias Applying Electrode

As shown in FIGS. 8 and 12, the developing bias applying electrode 164 is disposed on the right wall 163, and if the process cartridge 20 in which the developing cartridge 30 is mounted is mounted in the process cartridge containing portion 6, it is disposed to come into contact with the contact protruding portion 122 of the electrode member 117 of the developing cartridge 30.

Specifically, the developing bias applying electrode 164 is provided at a location where the contact protruding portion 122 of the electrode member 117 of the developing cartridge 30 is opposite to the developing bias applying electrode 164, in a state in which the process cartridge 20 is mounted in the process cartridge containing portion 6 in the middle of a forward-to-backward direction of the guide groove 166.

As shown in FIG. 13, the developing bias applying electrode 164 is made of a wire rod, such as a wire, and includes a winding portion 167 at which the conductive wire rod is wound around, and two arms 168 that extend respectively in different directions spaced apart from the winding portion 167. The free end of one arm 168 is curved in a wound shape, and the free end of the other arm 168 is bent in a substantially L shape.

Meanwhile, in the right wall 163 of the process cartridge containing portion 6, a conductive opening 169 for exposing the winding portion 167 of the developing bias applying electrode 164 from an external surface to an internal surface is formed to penetrate the right wall 163 in a thickness direction.

Further, at the lower end edge of the electrode opening 169, a central boss portion 170 on which the winding portion 167 is fitted is provided to protrude from the external surface of the right wall 163 in an outward direction of the widthwise direction. Further, in front of the electrode opening 169, the front boss portion 171 on which the free end of the one arm 168 is fitted is provided to protrude from the external surface of the right wall 163 in an outward direction of the widthwise direction. Further, at the rear of the electrode opening 169, a locking wall 172 for locking the free end of the other arm 168 is erected from the external surface of the right wall 163 in an outward direction of a widthwise direction The winding portion 167 of the developing bias applying electrode 164 is fitted on the central boss portion 170, the winding portion 167 is disposed to be exposed from the external surface of the right wall 163 to the internal surface, the free end of the one arm 168 is fitted on the front boss portion 171 to be supported, and the free end of the other arm 168 is locked to the locking wall 172.

In this way, the arms 168 are respectively supported to the front boss portion 171 and the locking wall 172, and thus the developing bias applying electrode 164 is assembled on the external surface of the right wall 163. If the respective arms 168 are supported, the winding portion 167 is biased upward by a bending force, and moves upward until the lower end of the winding portion 167 comes into contact with the central boss portion 170. As a result, as shown in FIG. 12, the winding portion 167 is exposed from the electrode opening portion 169 to the inner surface of the right wall 163 in the middle of a forward-to-backward direction of the guide groove 166. As will be described in detail below, the winding portion 167 is supported by each arm 168 so as to come into contact with the contact protruding portion 122 of the electrode member 117.

Further, one arm 168 of the developing bias applying electrode 164 is connected to a high voltage board (not shown) that is provided in the main body casing 2, and at the time of development (at the time of forming images), a developing bias is applied to the one arm 168 from the high voltage board.

4. Mounting of Process Cartridge into Process Cartridge Containing Portion (1) Mounting of process cartridge into process cartridge containing portion In mounting the process cartridge 20 into the process cartridge containing portion 6, first, the developing cartridge 30 is mounted on the cartridge mounting portion 147 of the drum frame 147. When the developing cartridge 30 is mounted on the cartridge mounting portion 147 of the drum frame 58, both shaft ends of the collar member 116 and the developing roller shaft covering portion 118 of the developing cartridge 30 are guided along the guide groove 153 (see FIG. 3) that is formed on both side walls 144 of the developing cartridge mounting portion 147, and the developing cartridge 30 is mounted on the cartridge mounting portion 147 of the drum frame 58.

If the developing cartridge 30 is mounted on the cartridge mounting portion 147 of the drum frame 58, as shown in FIGS. 2 and 3, the front end of each boss 132 comes into contact with each pressing lever 150, and each boss 132 is pressed backward by each pressing lever 150 by means of a biasing force of the compression spring for pressing on each pressing lever 150. In this case, the developing frame 36 moves backward relatively with respect to the cartridge mounting portion 147, and the rubber roller 53 of the developing roller 38 comes into contact with the photosensitive drum 28 in a pressurized state.

Further, if the developing cartridge 30 is mounted on the cartridge mounting portion 147 of the drum cartridge 27, a loading portion 133 is loaded on the loading board 155, and the loading plate 88 is loaded on the bottom wall 143 of the cartridge mounting portion 147.

Further, if the developing cartridge 30 is mounted on the cartridge mounting portion 147 of the drum cartridge 27, the engagement portion 181 is disposed below the lock lever. The lock lever 151 engages with an engagement portion 181 by means of a biasing force from the flexible plate 152. As a result, the mounting of the developing cartridge 30 on the cartridge mounting portion 147 of the drum frame 58 is locked. Further, when the developing cartridge 30 is detached from the cartridge mounting portion 147, if the lock lever 151 is pressed, the locking state of the lock lever 151 with respect to the engagement portion 181 is released.

Next, the process cartridge 20 on which the developing cartridge 30 is mounted is mounted into the process cartridge containing portion 6 of the main body casing 2.

When the process cartridge 20 on which the developing cartridge 30 is mounted is mounted on the process cartridge containing portion 6 of the main body casing 2, first, as shown in FIG. 1, the front cover 7 of the main body casing 2 is opened, and the process cartridge containing portion 6 is opened.

Next, the process cartridge 20 is mounted on the process cartridge containing portion 6 in an opened state. When the process cartridge 20 is mounted on the process cartridge containing portion 6, as shown in FIG. 12, both shaft ends of the drum shaft 34 are guided along the guide grooves 166 respectively formed in the left wall 162 and the right wall 163, so that the process cartridge 20 moves from the front side to the rear side. In addition, if the drum shaft 34 comes into contact with a ground electrode 165 disposed on the innermost portion of the guide groove 166, the mounting of the process cartridge 20 on the process cartridge containing portion 6 is completed. Then, the front cover 7 is closed, and the process cartridge containing portion 6 is closed.

(2) Operation of Gear Mechanism Portion

If the process cartridge 20 on which the developing cartridge 30 is mounted is mounted on the process cartridge containing portion 6 of the main body casing 2, as shown in FIGS. 5 and 8, the coupling driving portion 200 provided in the main body casing 2 is inserted into the coupling passive portion 100 of the input gear 94 of the developing cartridge 30, and then engages with the engagement claw 102. In this way, the coupling passive portion 100 and the coupling driving portion 200 are connected to each other so as to integrally rotate.

In addition, at the time of forming images, if a driving force from a motor (not shown) is applied to the coupling passive portion 100 from the coupling driving portion 200, as shown in FIG. 10, the input gear 94 is driven to rotate in an arrow direction (clockwise direction). In this case, the supply roller driving gear 95 that directly engages with the driving gear 101 of the input gear 94 is driven to rotate in an arrow direction (counterclockwise direction), then the supply roller shaft 50 rotates, and then supply roller 37 rotates.

Further, the supply roller driving gear 95 that directly engages with the driving gear 101 of the input gear 94 is driven to rotate in an arrow direction (counterclockwise direction), then the supply roller shaft 50 rotates, and then supply roller 37 rotates.

Furthermore, an external tooth 104 of the intermediate gear 96 that engages with the driving gear 101 of the input gear 94 is driven to rotate in an arrow direction (counterclockwise direction), an internal tooth 105 of the intermediate gear 96 that is integrally formed with the external tooth 104 is driven to rotate in an arrow direction (counterclockwise direction). If the internal tooth 105 of the intermediate gear 96 is driven to rotate in an arrow direction (counterclockwise direction), an internal tooth 106 of the agitator driving gear 97 that engages with the internal tooth 105 of the intermediate gear 96 is driven to rotate in an arrow direction (clockwise direction), the agitator rotation shaft 46 rotates, and the agitator 45 rotates.

Further, if the internal tooth 106 of the agitator driving gear 97 is driven to rotate, the external tooth 107 of the agitator driving gear 97 that is integrally formed with the internal tooth 106 is driven to rotate in an arrow direction (clockwise direction). In this case, the detecting gear 98 that engages with the external tooth 107 of the agitator driving gear 97 is driven to rotate in an arrow direction (counterclockwise direction).

Further, when the developing cartridge 30 is a new product, if the detecting gear 98 becomes a state shown in FIG. 10, and it is biased by means of a coil spring 110 so as to engage with the external tooth 107 of the agitator driving gear 97. In addition, if the detecting gear 98 is driven to rotate, the detecting gear 98 is stopped at a portion where the gear tooth is notched, and is not driven again to rotate. Therefore, as shown in FIG. 9, when the developing cartridge 30 is a new product, the new product determining protrusion 109 passes through the detection window 114 once in one direction. For this reason, in a laser printer 1, in a main body casing 2, it is determined that the mounted developing cartridge 30 is a new one depending on whether the passing through of the new product determining protrusion 109 is detected or not by a new product detecting sensor.

In addition, in the operation of the gear mechanism portion 92, as shown in FIG. 10, when the developing roller driving gear 115 and the driving gear 101 of the input gear 94 rotate, in an engagement portion between the developing roller driving gear 115 and the driving gear 101, a direction F1 of an engagement force applied to the developing roller driving gear 115, that is, a direction of a pressing angle between the developing roller driving gear 115 and the driving gear 101 is toward the rear opening 73 at the upper side of the inclined rear side, in a forward-to-backward direction, as shown by an arrow of FIG. 10.

(3) Operation of Electrode Member

If the process cartridge 20 on which the developing cartridge 30 is mounted is mounted on the process cartridge containing portion 6 of the main body casing 2, the winding portion 167 of the developing bias applying electrode 164 that is exposed from the electrode opening 169 (see FIG. 2) from the electrode opening (see FIG. 12) of the right wall 163 elastically comes into contact with the contact protruding portion 122 downward.

Specifically, the upper end of the winding portion 167 of the developing bias applying electrode 164 comes into contact with the bottom surface of the front end of the contact protruding portion 122.

If the winding portion 167 of the developing bias applying electrode 164 comes into contact with the bottom surface of the front end of the contact protruding portion 122, as shown in FIG. 14, the winding portion 167 presses on the bottom surface of the front end of the contact protruding portion 122 by means of a biasing force (spring force) of the developing bias applying electrode 164, and moves downward to be spaced apart from the central boss portion 170 by means of a reactive force.

In addition, at the time of forming images, the developing bias applied from the high voltage substrate is applied to the contact protruding portion 122 of the electrode member 117 from the developing bias applying electrode 164. In the electrode member 117, the developing bias applied from the developing bias applying electrode 164 is applied to the developing roller shaft 52 from the developing roller shaft covering portion 118. The developing bias applied to the developing roller 52 is applied to the rubber roller 53 from the developing roller shaft 52.

Further, in the developing electrode 117, the developing bias applied from the developing bias applying electrode 164 is applied to the supply roller shaft 50 from the supply roller shaft covering portion 127. The developing bias applied to the supply roller shaft 50 is applied to the sponge roller 51 from the supply roller shaft 50.

In addition, in the operation of the electrode member 117, as shown in FIG. 11, the winding portion 167 of the developing bias applying electrode 164 presses on the bottom surface of the front end of the contact protruding portion 122. As a result, the contacting portion between the winding portion 167 of the developing bias applying electrode 164 and the contact protruding portion 122 of the electrode member 117, a direction F2 of a pressing force applied to the contact protruding portion 122 is toward the rear opening 73 of the upper side of the inclined rear side in a forward-to-backward direction from the contacting portion between the winding portion 167 and the contact protruding portion 122, as shown by an arrow of FIG. 11.

In addition, a direction F2 of a pressing force applied to the contact protruding portion 122 shown in FIG. 11 is substantially equal to the direction F1 of the engagement direction applied to the developing roller driving gear 115 shown in FIG. 10 in a forward-to-backward direction, and an angle of a direction F2 of a pressing force applied to the contact protruding portion 122 shown in FIG. 11 is substantially equal to an angle of the direction F1 of the engagement direction applied to the developing roller driving gear 115 shown in FIG. 10 in a forward-to-backward direction. Specifically, the direction F2 of the pressing force applied to the contact protruding portion 122 shown in FIG. 11 and the direction F1 of the engagement force applied to the developing roller driving gear 115 shown in FIG. 10 becomes a direction toward the rear opening 73. That is, the direction F2 of the pressing force applied to the contact protruding portion 122 shown in FIG. 11 and the direction F1 of the engagement force applied to the developing roller driving gear 115 shown in FIG. 10*a* becomes substantially a direction where the rubber roller 53 of the developing roller 38 presses on the drum main body 33 of the photosensitive drum 28 such that a contact area between the rubber roller 53 of the developing roller 38 and the drum main body 33 of the photosensitive drum 28 is increased.

Further, as shown in FIG. 8, a straight line X2 that passes the contact portion between the winding portion 167 and the contact protruding portion 122, and the engagement portion between the developing roller driving gear 115 and the driving gear 101 is parallel to a straight line X1 that passes an axial direction of the developing roller shaft 52.

5. Advantage and Effect of the Present Aspect

As described above, if the developing cartridge 30 is mounted on the main body casing 2, in the left wall 69L, the coupling passive portion 100 of the input gear 94 is connected to the coupling driving portion 200 that is provided in the main body casing 2, and in the right wall 69R, the electrode member 117 comes into contact with the developing bias applying electrode 164.

In addition, at the time of forming images, in the input gear 94, a driving force from the coupling driving portion 200 is transmitted to the coupling passive portion 100, the driving force is transmitted from the driving gear 101 to the developing roller driving gear 115, and the developing roller 38 rotates. Further, the developing bias from the developing bias applying electrode 164 is applied to the electrode member 117, the developing bias is applied from the electrode member 117 to the developing roller shaft 52, and the developing bias is applied to the developing roller 38.

In addition, at the time of forming images, in the developing cartridge 30, a direction F1 of the engagement force applied to the developing roller driving gear 115 shown in FIG. 10 and the direction F2 of the pressing force F2 applied to the contact protruding portion 122 shown in FIG. 11 are substantially equal to each other in a forward-to-backward direction.

For this reason, at the time of forming images, in an axial direction of the developing roller shaft 52, the developing cartridge 30 is pressed in the same direction with an excellent balance from both sides of the axial direction. In the axial direction of the developing roller shaft 52, it is possible to prevent torsion from being generated in the developing cartridge 30. As a result, it is possible to prevent defects occurring when the images are formed.

Further, in the developing cartridge 30, a straight line X2 that passes the contact portion between the winding portion 167 and the contact protruding portion 122, and the engagement portion between the developing roller driving gear 115 and the driving gear 101 is parallel to a straight line X1 that passes an axial direction of the developing roller shaft 52. For this reason, an action point of the engagement force applied to the developing roller driving gear 115 and an action point of a pressing force applied to the electrode member 117 are disposed on the same straight line. Therefore, the torsion occurring in the developing cartridge 30 can be further effectively prevented.

Further, in the electrode member 117, by using the developing roller shaft covering portion 118, the contact protruding portion 122 can come into contact with the developing bias applying electrode 164 while supporting the developing roller shaft 52. For this reason, the number of components can be reduced, the developing roller 38 can be easily or surely supported, and the developing bias can be easily or surely applied to the developing roller 38.

Further, at the time of forming images, a direction F2 of the pressing force applied to the contact protruding portion 122 shown in FIG. 11 and a direction F1 of an engagement force applied to the developing roller driving gear 115 shown in FIG. 10 are toward the rear opening 73. For this reason, at the time of forming images, the rubber roller 53 of the developing roller 38 can be pressed on the drum main body 33 of the photosensitive drum 28. As a result, at the time of forming images, the contact area between the rubber roller 53 of the developing roller 38 and the drum main body of the photosensitive drum 28 can be increased, which results in achieving sure developing.

Further, since the input gear 94 includes the coupling passive portion 100 and the driving gear 101 on the same rotation shaft to be integrally provided, a driving force from the coupling driving portion 200 can be effectively transmitted to the developing roller driving gear 115 while reducing the number of components.

In addition, as described above, since the process cartridge 20 includes the developing cartridge 30 in which the torsion can be prevented from occurring, at the time of forming images, the stable development of the photosensitive drum 28 can be achieved. Further, since the laser printer 1 includes the developing cartridge 30 in which the torsion can be prevented from occurring, at the time of forming images, it is possible to prevent the defects occurring when the images are formed, due to the torsion of the developing cartridge 30.

Further, in the laser printer 1, in the developing bias applying electrode 164 that comes into contact with the contact protruding portion 122 of the electrode member 117, in a state in which the two arms 168 are respectively supported to the boss portion 171 and the locking wall 172, the winding portion 167 comes into contact with the contact protruding portion 122 of the electrode member 117 between these arms 168. For this reason, as compared with a case in which the winding portion 167 is pivoted in a state in which it is supported by one end, a pivot range can be reduced, and an arrangement space necessary when the winding portion 167 is disposed can be reduced. For this reason, it is possible to achieve a small-sized laser printer 1.

3. Modification (1) Modification Related to Process Cartridge.

In the above-mentioned description, the developing cartridge 30 is mounted on the drum cartridge 27 to be used as the process cartridge 20, and the process cartridge 20 is attached to or detached from the main body casing 2. However, the photosensitive drum 28, the scorotron charger 29, the transfer roller 31, and the cleaning member 32 are provided in the main body casing 2, and the developing cartridge 30 can be attached to or detached from the main body casing 2. Further, the photosensitive drum 28, the scorotron charger 29, the transfer roller 31, and the cleaning member 32 are provided in the developing cartridge 30, and the developing cartridge 30 can be attached to or detached from the main body casing 2.

(2) Modification Related to Gear Mechanism Portion

In the above-mentioned description, in the gear mechanism portion 92, the driving gear 101 is used as the transmitting gear of the invention, and the driving gear 101 and the developing roller driving gear 115 directly engage with each other. In the invention, the transmitting gear that engages with the developing roller driving gear 115 can be provided separately from the driving gear 101, and a driving force from the driving gear 101 can be transmitted to the developing roller driving gear 115 through the transmission gear. Further, one or two or more of intermediate gears can be interposed between the driving gear 101 and the transmitting gear as the driving force transmitting unit, and thus a driving force from the driving gear 101 can be transmitted to the developing roller driving gear 115 through the intermediate gear and the transmitting gear.

(3) Modification Related to Developing Bias Applying Electrode

In the above-mentioned description, the developing bias applying electrode 164 is supported on the right wall 163 of the main body casing 2. However, for example, the developing bias applying electrode 164 can be supported on the side wall 144 of the drum cartridge 28, and the developing bias applying electrode 164 can come into contact with the electrode member 117. In addition, when the developing bias applying electrode 164 is mounted on the main body casing 2, it is connected to the contact that is provided in the main body casing 2, and the developing bias can be applied to the electrode member 117 from the contact provided in the main body casing 2 through the developing bias applying electrode 164.

(4) Modification Related to Laser Printer

Further, in the above-described description, the monochrome-type laser printer has been exemplified as an aspect of the image forming apparatus of the invention, but the image forming apparatus of the invention is not limited thereto. It may be a color laser printer, specifically, may be a tandem-typed color laser printer.

What is claimed is:

1. A developing cartridge that is attachable to and detachable from an image forming apparatus, comprising:

a developing roller that includes a developing roller shaft, which rotates at a time of development, a developing roller member provided at a circumference of the developing roller shaft to carry a developer, and a developing roller gear provided to rotate integrally with the developing roller shaft at one side of the developing roller shaft in an axial direction;

a driving force transmitting unit that is disposed on the one side of the developing roller shaft in the axial direction and transmits a driving force from a driving rotator provided in the image forming apparatus to the developing roller gear, the driving force transmitting unit including a driven rotator connectable to the driving rotator and a transmission gear that engages with the developing roller gear; and an electrode member that is disposed on an other side of the developing roller shaft in the axial direction and comes into contact with a power supply member to apply a bias supplied by the power supply member to the developing roller shaft, wherein a direction of the driving force applied to the developing roller gear at an engagement portion between the developing roller gear and the transmission gear when the developing roller gear and the transmission gear rotate, and a direction of a force applied to the electrode member at a contact portion between the power supply member and the electrode member when the power supply member presses on the electrode member are substantially equal to a direction orthogonal to the axial direction of the developing roller shaft.

2. The developing cartridge according to claim 1, wherein the engagement portion between the developing roller gear and the transmission gear, and the contact portion between the power supply member and the electrode member are disposed on a straight line that is parallel to the developing roller shaft.

3. The developing roller cartridge according to claim 1, wherein the electrode member includes a developing roller supporting portion that supports the developing roller shaft and a contact portion that comes into contact with the power supply member, which are integrally provided.

4. The developing cartridge according to claim 1, further comprising a casing that contains the developing roller and has an opening through which the developing roller member is partially exposed, wherein a direction of the driving force applied to the developing roller gear and a direction of the force applied to the electrode member extend toward the opening from the engagement portion between the developing roller gear and the transmission gear and the contact portion between the power supply member and the electrode member, respectively, in the direction orthogonal to the axial direction of the developing roller shaft.

5. The developing cartridge according to claim 1, wherein the driving force transmitting unit includes the driven rotator and the transmission gear, which are integrally provided on a same rotation axial line.

6. A process cartridge that is attachable to and detachable from an image forming device, comprising:

a developing cartridge comprising:

a developing roller that includes a developing roller shaft, which rotates at a time of development, a developing roller member provided at a circumference of the developing roller shaft to carry a developer, and a developing roller gear provided to rotate integrally with the developing roller shaft at one side of the developing roller shaft in an axial direction;

a driving force transmitting unit that is disposed on the one side of the developing roller shaft in the axial direction and transmits a driving force from a driving rotator provided in the image forming apparatus to the developing roller gear, the driving force transmitting unit including a driven rotator connectable to the driving rotator and a transmission gear that engages with the developing roller gear; and an electrode member that is disposed on an other side of the developing roller shaft in the axial direction and comes into contact with a power supply member to apply a bias supplied by the power supply member to the developing roller shaft, wherein a direction of the driving force applied to the developing roller gear at an engagement portion between the developing roller gear and the transmission gear when the developing roller gear and the transmission gear rotate, and a direction of a force applied to the electrode member at a contact portion between the power supply member and the electrode member when the power supply member presses on the electrode member are substantially equal to a direction orthogonal to the axial direction of the developing roller shaft;

a photosensitive member on which an electrostatic latent image is formed; and a developing cartridge containing portion that contains the developing cartridge.

7. The process cartridge according to claim 6, wherein the developing roller member comes into contact with the photosensitive member, and the direction of the driving force applied to the developing roller gear, and the direction of the force applied to the electrode member are substantially equal to a direction in which the developing roller member presses on the photosensitive member to increase a contact area between the developing roller member and the photosensitive member.

8. An image forming apparatus comprising:

a process cartridge;

a process cartridge containing portion that contains the process cartridge;

a driving rotator; and a power supply member, wherein the process cartridge comprises:

a developing cartridge comprising:

a developing roller that includes a developing roller shaft, which rotates at a time of development, a developing roller member provided at a circumference of the developing roller shaft to carry a developer, and a developing roller gear provided to rotate integrally with the developing roller shaft at one side of the developing roller shaft in an axial direction;

a driving force transmitting unit that is disposed on the one side of the developing roller shaft in the axial direction and transmits a driving force from the driving rotator provided in the image forming apparatus to the developing roller gear, the driving force transmitting unit including a driven rotator connectable to the driving rotator and a transmission gear that engages with the developing roller gear; and an electrode member that is disposed on an other side of the developing roller shaft in the axial direction and comes into contact with the power supply member to apply a bias supplied by the power supply member to the developing roller shaft, wherein a direction of the driving force applied to the developing roller gear at an engagement portion between the developing roller gear and the transmission gear when the developing roller gear and the transmission gear rotate, and a direction of a force applied to the electrode member at a contact portion between the power supply member and the electrode member when the power supply member presses on the electrode member are substantially equal to a direction orthogonal to the axial direction of the developing roller shaft;

a photosensitive member on which an electrostatic latent image is formed; and a developing cartridge containing portion that contains the developing cartridge.

9. The image forming apparatus according to claim 8, wherein the power supply member is made of a conductive wire rod and includes a winding portion at which the conductive wire rod is wound around, and two arms that extend respectively in different directions from the winding portion, and supporting portions for supporting the two arms are provided in the process cartridge containing portion such that the electrode member of the developing cartridge comes into contact with the winding portion.

10. An image forming apparatus comprising:

a developing cartridge;

a developing cartridge containing portion that contains the developing cartridge;

a driving rotator; and a power supply member, wherein the developing cartridge comprises:

a developing roller that includes a developing roller shaft, which rotates at a time of development, a developing roller member provided at a circumference of the developing roller shaft to carry a developer, and a developing roller gear provided to rotate integrally with the developing roller shaft at one side of the developing roller shaft in an axial direction;

a driving force transmitting unit that is disposed on the one side of the developing roller shaft in the axial direction and transmits a driving force from the driving rotator provided in the image forming apparatus to the developing roller gear, the driving force transmitting unit including a driven rotator connectable to the driving rotator and a transmission gear that engages with the developing roller gear; and an electrode member that is disposed on an other side of the developing roller shaft in the axial direction and comes into contact with the power supply member to apply a bias supplied by the power supply member to the developing roller shaft, wherein a direction of the driving force applied to the developing roller gear at an engagement portion between the developing roller gear and the transmission gear when the developing roller gear and the transmission gear rotate, and a direction of a force applied to the electrode member at a contact portion between the power supply member and the electrode member when the power supply member presses on the electrode member are substantially equal to a direction orthogonal to the axial direction of the developing roller shaft.

11. The image forming apparatus according to claim 10, wherein the power supply member is made of a conductive wire rod, and includes a winding portion at which the conductive wire rod is wound around, and two arms that extend respectively in different directions from the winding portion, and supporting portions for supporting the two arms are provided in the developing cartridge containing portion such that the electrode member of the developing cartridge comes into contact with the winding portion.

* * * * *

UNITED STATES PATENT AND TRADEMARK OFFICE

CERTIFICATE OF CORRECTION

PATENT NO. : 7,613,414 B2
APPLICATION NO. : 11/526601
DATED : November 3, 2009
INVENTOR(S) : Naoya Kamimura It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 455 days.

Signed and Sealed this

Nineteenth Day of October, 2010

David J. Kappos

David J. Kappos
*Director of the United States Patent and Trademark Office*